US011256189B2

(12) United States Patent
Kuwabara et al.

(10) Patent No.: US 11,256,189 B2
(45) **Date of Patent: *Feb. 22, 2022**

(54) TONER CONTAINER, IMAGE FORMING UNIT, AND IMAGE FORMING APPARATUS

(71) Applicant: Oki Data Corporation, Tokyo (JP)

(72) Inventors: Hideharu Kuwabara, Tokyo (JP); Shin Yamada, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/027,108

(22) Filed: Sep. 21, 2020

(65) Prior Publication Data

US 2021/0011392 A1 Jan. 14, 2021

Related U.S. Application Data

(63) Continuation of application No. 16/656,713, filed on Oct. 18, 2019, now Pat. No. 10,948,840.

(30) Foreign Application Priority Data

Nov. 27, 2018 (JP) ..... JP2018-221275
Aug. 30, 2019 (JP) ..... JP2019-157723

(51) Int. Cl.
*G03G 9/08* (2006.01)
*G03G 13/01* (2006.01)
(Continued)

(52) U.S. Cl.
CPC ..... *G03G 13/0133* (2021.01); *G03G 9/087* (2013.01); *G03G 9/0821* (2013.01);
(Continued)

(58) Field of Classification Search
CPC .... G03G 9/0821; G03G 9/0918; G03G 9/092; G03G 9/0906; G03G 9/0904; G03G 9/091
See application file for complete search history.

(56) References Cited

U.S. PATENT DOCUMENTS 7,288,356 B2 10/2007 Ayaki et al.
10,948,840 B2 * 3/2021 Kuwabara ..... G03G 9/087
2013/0017480 A1 1/2013 Suzuki et al.

FOREIGN PATENT DOCUMENTS

JP H03276163 A 12/1991
JP 2004258397 A 9/2004
JP 2013125176 A 6/2013

OTHER PUBLICATIONS

"The Color of Art Pigment Database: Pigment Blue, PB" [retrieved Jul. 2, 2021] Retrieved from Interent <URL:http://www.artiscreation.com/blue.html>. (Year: 2021).*

(Continued)

*Primary Examiner* — Mark A Chapman
(74) *Attorney, Agent, or Firm* — Rabin & Berdo, P.C.

(57) ABSTRACT

A toner container used in an image forming apparatus including an exposure unit with a light emitting diode light source. The toner container including a container body, and a cyan toner stored in the container body. The cyan toner includes a binder resin, at least one pigment, a charge control agent, and an external additive. The at least one pigment includes at least Pigment Blue. A lightness L*, a hue a*, and a hue b* of the cyan toner in a powder state satisfy: $30.04 \leq L^* \leq 33.68$, $-1.75 \leq a^* \leq 0.71$, and $-47.47 \leq b^* \leq -45.08$.

14 Claims, 27 Drawing Sheets

(51) Int. Cl.

| | |
|---|---|
| ***G03G 9/09*** | (2006.01) |
| ***G03G 9/087*** | (2006.01) |
| ***G03G 15/01*** | (2006.01) |
| ***G03G 15/04*** | (2006.01) |
| ***G03G 15/20*** | (2006.01) |
| ***G03G 15/00*** | (2006.01) |

(52) U.S. Cl.
CPC ..... *G03G 9/091* (2013.01); *G03G 9/092* (2013.01); *G03G 9/0904* (2013.01); *G03G 9/0906* (2013.01); *G03G 9/0918* (2013.01); *G03G 9/0926* (2013.01); *G03G 15/0126* (2013.01); *G03G 15/0178* (2013.01); *G03G 15/04054* (2013.01); *G03G 15/2064* (2013.01); *G03G 15/556* (2013.01); *G03G 2215/0174* (2013.01)

(56) References Cited

OTHER PUBLICATIONS

"The Color of Art Pigment Database: Pigment Green, PG" [retrieved Jul. 2, 2021] Retrieved from Interent <URL:http://www.artiscreation.com/green.html#ci_pigment_green>. (Year: 2021).*
Diamond, Arthur S. (editor), Handbook of Imaging Materials. New York: Marce-Dekker, Inc. pp. 146-164 (2001).
English language machine translation of JP 03-276163 (Dec. 1991).
English language machine translation of JP 2013-125176 (Jun. 2013).

* cited by examiner

FIG. 11

| EXAMPLE | CYAN TONER | AMOUNT OF CYAN PIGMENT (PARTS BY WEIGHT) | | CYAN PIGMENT AMOUNT RATIO | POWDER COLOR | | | $D_{50}$ ($\mu$m) | T1/2 (°C) | Tg_1st (°C) | Tg_2nd (°C) |
|---|---|---|---|---|---|---|---|---|---|---|---|
| | | PB15:3 | PG7 | PG15:3 / PG7 | L* | a* | b* | | | | |
| EXAMPLE 1 | C-1 | 5.6 | 0.5 | 0.09 | 33.68 | -1.75 | -47.47 | 4.8 | 107.9 | 56.4 | 53.2 |
| EXAMPLE 2 | C-2 | 5.9 | 0.6 | 0.10 | 31.27 | 0.16 | -46.52 | 6.3 | 106.8 | 59.7 | 52.3 |
| EXAMPLE 3 | C-3 | 6.3 | 0.6 | 0.10 | 30.04 | 0.71 | -45.08 | 6.6 | 109.4 | 64.7 | 52.6 |
| EXAMPLE 4 | C-4 | 3.7 | 0.4 | 0.10 | 34.84 | -3.71 | -47.24 | 6.0 | 108.4 | 60.0 | 53.0 |
| EXAMPLE 5 | C-5 | 8.7 | 0.9 | 0.10 | 27.14 | 3.83 | -44.41 | 6.5 | 108.8 | 58.7 | 56.2 |
| EXAMPLE 6 | C-6 | 8.7 | 1.1 | 0.13 | 27.48 | -2.16 | -39.78 | 6.5 | 110.0 | 64.3 | 55.1 |
| EXAMPLE 7 | C-7 | 8.7 | 2.4 | 0.27 | 26.94 | -5.13 | -36.78 | 6.5 | 110.7 | 65.5 | 54.0 |
| EXAMPLE 8 | C-8 | 3.5 | 0.4 | 0.10 | 35.11 | -4.35 | -46.26 | 6.5 | 108.1 | 62.9 | 53.8 |
| EXAMPLE 9 | C-9 | 3.1 | 0.3 | 0.10 | 36.57 | -4.93 | -47.12 | 6.6 | 106.5 | 60.4 | 51.7 |

FIG. 12

| EXAMPLE | CYAN TONER | POWDER COLOR | | | LINEAR APPROXIMATION | | IMAGE DENSITIES AND EVALUATIONS | | | | |
|---|---|---|---|---|---|---|---|---|---|---|---|
| | | L* | a* | b* | LINEAR FUNCTION | COEFFICIENT OF DETERMINATION ($R^2$) | 0.30 ($mg/cm^2$) | EVALU-ATION | 0.35 ($mg/cm^2$) | EVALU-ATION | TONER DEPOSITION AMOUNT AT IMAGE DENSITY 1.50 ($mg/cm^2$) |
| EXAMPLE 1 | C-1 | 33.68 | -1.75 | -47.47 | y = 2.7977x + 0.6566 | $R^2$ = 0.9748 | 1.50 | EXCELLENT | 1.62 | EXCELLENT | 0.30 |
| EXAMPLE 2 | C-2 | 31.27 | 0.16 | -46.52 | y = 1.3785x + 1.0839 | $R^2$ = 0.9385 | 1.50 | EXCELLENT | 1.57 | EXCELLENT | 0.30 |
| EXAMPLE 3 | C-3 | 30.04 | 0.71 | -45.08 | y = 1.9437x + 0.996 | $R^2$ = 0.9358 | 1.58 | EXCELLENT | 1.68 | EXCELLENT | 0.26 |
| EXAMPLE 4 | C-4 | 34.84 | -3.71 | -47.24 | y = 2.0284x + 0.7892 | $R^2$ = 0.9439 | 1.40 | GOOD | 1.50 | EXCELLENT | 0.35 |
| EXAMPLE 5 | C-5 | 27.14 | 3.83 | -44.41 | y = 1.5047x + 1.0639 | $R^2$ = 0.9249 | 1.52 | EXCELLENT | 1.59 | EXCELLENT | 0.29 |
| EXAMPLE 6 | C-6 | 27.48 | -2.16 | -39.78 | y = 1.9213x + 0.9374 | $R^2$ = 0.9301 | 1.51 | EXCELLENT | 1.61 | EXCELLENT | 0.29 |
| EXAMPLE 7 | C-7 | 26.94 | -5.13 | -36.78 | y = 1.8454x + 0.971 | $R^2$ = 0.9056 | 1.52 | EXCELLENT | 1.62 | EXCELLENT | 0.29 |
| EXAMPLE 8 | C-8 | 35.11 | -4.35 | -46.26 | y = 1.891x + 0.7671 | $R^2$ = 0.9522 | 1.33 | POOR | 1.43 | GOOD | 0.39 |
| EXAMPLE 9 | C-9 | 36.57 | -4.93 | -47.12 | y = 2.273x + 0.5803 | $R^2$ = 0.9547 | 1.26 | POOR | 1.38 | POOR | 0.40 |

FIG. 13

| EXAMPLE | CYAN TONER | AVERAGE PRINT COLOR (B) | | | AVERAGE PRINT COLOR (C) | | | AVERAGE PRINT COLOR (G) | | | COLOR DIFFERENCES AND EVALUATIONS | | | | | |
|---|---|---|---|---|---|---|---|---|---|---|---|---|---|---|---|---|
| | | | | | | | | | | | BLUE (B) | | CYAN (C) | | GREEN (G) | |
| | | L* | a* | b* | L* | a* | b* | L* | a* | b* | ΔE | EVALUATION | ΔE | EVALUATION | ΔE | EVALUATION |
| EXAMPLE 1 | C-1 | 15.3 | 22.0 | -45.1 | 47.1 | -26.2 | -52.2 | 38.2 | -65.3 | 23.8 | 7.5 | EXCELLENT | 12.0 | EXCELLENT | 11.0 | EXCELLENT |
| EXAMPLE 2 | C-2 | 16.3 | 20.8 | -41.6 | 46.1 | -26.2 | -52.4 | 36.8 | -64.4 | 18.3 | 8.4 | EXCELLENT | 12.5 | EXCELLENT | 13.2 | EXCELLENT |
| EXAMPLE 3 | C-3 | 15.8 | 19.4 | -42.1 | 45.7 | -25.5 | -53.7 | 36.1 | -65.5 | 19.0 | 8.4 | EXCELLENT | 13.4 | EXCELLENT | 13.1 | EXCELLENT |
| EXAMPLE 4 | C-4 | 17.2 | 22.1 | -47.0 | 47.6 | -27.0 | -53.2 | 40.5 | -67.3 | 24.9 | 5.3 | EXCELLENT | 11.1 | EXCELLENT | 8.3 | EXCELLENT |
| EXAMPLE 5 | C-5 | 15.2 | 22.2 | -42.1 | 43.4 | -21.7 | -52.1 | 37.2 | -59.8 | 22.0 | 9.1 | EXCELLENT | 17.7 | GOOD | 15.1 | EXCELLENT |
| EXAMPLE 6 | C-6 | 14.5 | 20.1 | -40.2 | 44.7 | -26.0 | -49.2 | 33.3 | -62.1 | 17.6 | 10.6 | EXCELLENT | 13.7 | EXCELLENT | 17.5 | GOOD |
| EXAMPLE 7 | C-7 | 15.5 | 16.2 | -38.0 | 44.4 | -28.6 | -47.3 | 34.1 | -61.1 | 18.1 | 12.3 | EXCELLENT | 12.6 | EXCELLENT | 17.2 | GOOD |
| EXAMPLE 8 | C-8 | 18.2 | 20.6 | -42.1 | 47.7 | -27.8 | -52.7 | 42.7 | -65.0 | 27.3 | 6.8 | EXCELLENT | 10.3 | EXCELLENT | 9.0 | EXCELLENT |
| EXAMPLE 9 | C-9 | 19.1 | 20.3 | -41.8 | 49.8 | -29.4 | -51.2 | 43.0 | -65.2 | 25.7 | 6.6 | EXCELLENT | 7.8 | EXCELLENT | 7.9 | EXCELLENT |

FIG. 14

TONER DEPOSITION AMOUNT AT IMAGE DENSITY 1.50 (FIG. 12)

COMPREHENSIVE EVALUATION

| EXAMPLE | CYAN TONER | IMAGE DENSITIES AND EVALUATIONS (FIG. 12) | | | | | COLOR DIFFERENCES AND EVALUATIONS (FIG. 13) | | | | | | |
|---|---|---|---|---|---|---|---|---|---|---|---|---|---|
| | | | | | | | BLUE (B) | | CYAN (C) | | GREEN (G) | | |
| | | 0.30 (mg/cm$^2$) | EVALUATION | 0.35 (mg/cm$^2$) | EVALUATION | (mg/cm$^2$) | ΔE | EVALUATION | ΔE | EVALUATION | ΔE | EVALUATION | |
| EXAMPLE 1 | C-1 | 1.50 | EXCELLENT | 1.62 | EXCELLENT | 0.30 | 7.5 | EXCELLENT | 12.0 | EXCELLENT | 11.0 | EXCELLENT | A |
| EXAMPLE 2 | C-2 | 1.50 | EXCELLENT | 1.57 | EXCELLENT | 0.30 | 8.4 | EXCELLENT | 12.5 | EXCELLENT | 13.2 | EXCELLENT | A |
| EXAMPLE 3 | C-3 | 1.58 | EXCELLENT | 1.68 | EXCELLENT | 0.26 | 8.4 | EXCELLENT | 13.4 | EXCELLENT | 13.1 | EXCELLENT | A |
| EXAMPLE 4 | C-4 | 1.40 | GOOD | 1.50 | EXCELLENT | 0.35 | 5.3 | EXCELLENT | 11.1 | EXCELLENT | 8.3 | EXCELLENT | B |
| EXAMPLE 5 | C-5 | 1.52 | EXCELLENT | 1.59 | EXCELLENT | 0.29 | 9.1 | EXCELLENT | 17.7 | GOOD | 15.1 | EXCELLENT | B |
| EXAMPLE 6 | C-6 | 1.51 | EXCELLENT | 1.61 | EXCELLENT | 0.29 | 10.6 | EXCELLENT | 13.7 | EXCELLENT | 17.5 | GOOD | B |
| EXAMPLE 7 | C-7 | 1.52 | EXCELLENT | 1.62 | EXCELLENT | 0.29 | 12.3 | EXCELLENT | 12.6 | EXCELLENT | 17.2 | GOOD | B |
| EXAMPLE 8 | C-8 | 1.33 | POOR | 1.43 | GOOD | 0.39 | 6.8 | EXCELLENT | 10.3 | EXCELLENT | 9.0 | EXCELLENT | C |
| EXAMPLE 9 | C-9 | 1.26 | POOR | 1.38 | POOR | 0.40 | 6.6 | EXCELLENT | 7.8 | EXCELLENT | 7.9 | EXCELLENT | C |

FIG. 15

| EXAMPLE COMPARATIVE EXAMPLE | YELLOW TONER | AMOUNT OF YELLOW PIGMENT (PARTS BY WEIGHT) | YELLOW PIGMENT AMOUNT RATIO | POWDER COLOR | | | $D_{50}$ (μm) | T1/2 (°C) | Tg_1st (°C) | Tg_2nd (°C) |
|---|---|---|---|---|---|---|---|---|---|---|
| | | PY185 | | L* | a* | b* | | | | |
| EXAMPLE 10 | Y-1 | 20.0 | – | 87.12 | -7.60 | 105.96 | 6.4 | 106.9 | 54.6 | 51.2 |
| EXAMPLE 11 | Y-2 | 20.0 | – | 87.14 | -4.14 | 108.32 | 6.4 | 107.8 | 59.4 | 52.4 |
| EXAMPLE 12 | Y-3 | 15.8 | – | 87.73 | -8.68 | 105.62 | 6.3 | 106.6 | 62.2 | 53.5 |
| EXAMPLE 13 | Y-4 | 15.8 | – | 87.81 | -5.39 | 107.86 | 6.5 | 108.1 | 62.5 | 54.0 |
| EXAMPLE 14 | Y-5 | 20.0 | – | 86.96 | -6.75 | 106.73 | 6.0 | 104.2 | 56.1 | 51.1 |
| EXAMPLE 15 | Y-6 | 20.0 | – | 87.43 | -5.33 | 107.40 | 6.4 | 108.8 | 58.0 | 52.4 |
| COMPARATIVE EXAMPLE 1 | Y-7 | 9.4 | – | 88.47 | -7.76 | 106.88 | 6.5 | 106.7 | 60.5 | 51 1 |
| COMPARATIVE EXAMPLE 2 | Y-8 | 9.4 | – | 89.28 | -9.10 | 104.93 | 6.3 | 105.8 | 56.9 | 54.2 |

FIG. 16

| EXAMPLE COMPARATIVE EXAMPLE | MAGENTA TONER | AMOUNT OF MAGENTA PIGMENT (PARTS BY WEIGHT) | | MAGENTA PIGMENT AMOUNT RATIO | POWDER COLOR | | | $D_{50}$ (μm) | T1/2 (°C) | Tg_1st (°C) | Tg_2nd (°C) |
|---|---|---|---|---|---|---|---|---|---|---|---|
| | | QUINACRIDONE (QD) | CARMINE (CM) | QD/CM | L* | a* | b* | | | | |
| EXAMPLE 16 | M-1 | 11.2 | 7.5 | 0.67 | 33.84 | 58.72 | 15.11 | 6.2 | 108.6 | 61.8 | 52.8 |
| EXAMPLE 17 | M-2 | 11.2 | 7.5 | 0.67 | 35.53 | 60.46 | 12.87 | 6.0 | 112.7 | 63.6 | 54.4 |
| EXAMPLE 18 | M-3 | 11.2 | 7.5 | 0.67 | 34.70 | 59.11 | 17.30 | 6.5 | 112.2 | 64.1 | 55.3 |
| EXAMPLE 19 | M-4 | 12.1 | 8.1 | 0.67 | 35.30 | 60.55 | 13.37 | 6.3 | 111.6 | 63.8 | 55.5 |
| EXAMPLE 20 | M-5 | 14.4 | 9.6 | 0.67 | 34.28 | 59.11 | 15.81 | 6.0 | 111.7 | 56.9 | 54.8 |
| EXAMPLE 21 | M-6 | 8.4 | 5.6 | 0.67 | 36.51 | 61.47 | 11.71 | 6.5 | 111.6 | 57.4 | 54.7 |
| COMPARATIVE EXAMPLE 3 | M-7 | 5.7 | 3.8 | 0.67 | 38.61 | 63.71 | 7.35 | 6.4 | 110.5 | 61.8 | 55.8 |
| COMPARATIVE EXAMPLE 4 | M-8 | 5.7 | 3.8 | 0.67 | 39.68 | 63.48 | 5.95 | 6.4 | 108.5 | 56.7 | 55.0 |

FIG. 17

| EXAMPLE / COMPARATIVE EXAMPLE | BLACK TONER | AMOUNT OF BLACK PIGMENT (PARTS BY WEIGHT) CARBON BLACK (CB) | BLACK PIGMENT AMOUNT RATIO | POWDER COLOR L* | POWDER COLOR a* | POWDER COLOR b* | $D_{50}$ ($\mu$m) | T1/2 (°C) | Tg_1st (°C) | Tg_2nd (°C) |
|---|---|---|---|---|---|---|---|---|---|---|
| EXAMPLE 22 | K-1 | 10.5 | – | 11.14 | 0.00 | −0.27 | 6.4 | 108.3 | 61.8 | 54.9 |
| EXAMPLE 23 | K-2 | 10.5 | – | 10.59 | 0.12 | −0.22 | 6.3 | 105.7 | 60.7 | 54.3 |
| EXAMPLE 24 | K-3 | 10.5 | – | 11.01 | 0.16 | −0.39 | 6.5 | 106.6 | 59.8 | 55.4 |
| EXAMPLE 25 | K-4 | 13.4 | – | 11.13 | −0.01 | −0.52 | 6.5 | 108.0 | 58.0 | 54.5 |
| EXAMPLE 26 | K-5 | 10.5 | – | 11.35 | 0.21 | −0.30 | 6.0 | 105.4 | 56.2 | 52.1 |
| EXAMPLE 27 | K-6 | 10.5 | – | 11.08 | 0.19 | −0.14 | 6.0 | 109.6 | 58.0 | 53.9 |
| COMPARATIVE EXAMPLE 5 | K-7 | 7.3 | – | 11.67 | 0.34 | 0.01 | 6.5 | 106.8 | 60.7 | 53.3 |
| COMPARATIVE EXAMPLE 6 | K-8 | 7.3 | – | 12.87 | 0.31 | 0.01 | 6.4 | 105.6 | 58.8 | 55.2 |

FIG. 18

| EXAMPLE COMPARATIVE EXAMPLE | YELLOW TONER | POWDER COLOR | | | LINEAR APPROXIMATION | COEFFICIENT OF DETERMINATION ( $R^2$ ) | IMAGE DENSITIES AND EVALUATIONS | | | | TONER DEPOSITION AMOUNT AT IMAGE DENSITY 1.50 |
|---|---|---|---|---|---|---|---|---|---|---|---|
| | | L* | a* | b* | LINEAR FUNCTION | | 0.31 (mg/cm²) | EVALU-ATION | 0.35 (mg/cm²) | EVALU-ATION | (mg/cm²) |
| EXAMPLE 10 | Y-1 | 87.12 | -7.60 | 105.96 | y = 2.2713x + 0.8135 | $R^2$ = 0.8736 | 1.53 | EXCELLENT | 1.61 | EXCELLENT | 0.30 |
| EXAMPLE 11 | Y-2 | 87.14 | -4.14 | 108.32 | y = 1.7004x + 0.9850 | $R^2$ = 0.9295 | 1.52 | EXCELLENT | 1.58 | EXCELLENT | 0.30 |
| EXAMPLE 12 | Y-3 | 87.73 | -8.68 | 105.62 | y = 1.6227x + 0.9883 | $R^2$ = 0.9476 | 1.50 | EXCELLENT | 1.55 | EXCELLENT | 0.32 |
| EXAMPLE 13 | Y-4 | 87.81 | -5.39 | 107.86 | y = 1.8703x + 0.8837 | $R^2$ = 0.9250 | 1.47 | GOOD | 1.54 | EXCELLENT | 0.33 |
| EXAMPLE 14 | Y-5 | 86.96 | -6.75 | 106.73 | y = 2.2740x + 0.7533 | $R^2$ = 0.8987 | 1.47 | GOOD | 1.55 | EXCELLENT | 0.33 |
| EXAMPLE 15 | Y-6 | 87.43 | -5.33 | 107.40 | y = 2.5634x + 0.6199 | $R^2$ = 0.9199 | 1.42 | GOOD | 1.52 | EXCELLENT | 0.34 |
| COMPARATIVE EXAMPLE 1 | Y-7 | 88.47 | -7.76 | 106.88 | y = 1.9339x + 0.7331 | $R^2$ = 0.9804 | 1.34 | POOR | 1.41 | GOOD | 0.40 |
| COMPARATIVE EXAMPLE 2 | Y-8 | 89.28 | -9.10 | 104.93 | y = 1.7757x + 0.663 | $R^2$ = 0.9577 | 1.22 | POOR | 1.28 | POOR | 0.47 |

FIG. 19

| EXAMPLE / COMPARATIVE EXAMPLE | MAGENTA TONER | POWDER COLOR | | | LINEAR APPROXIMATION | COEFFICIENT OF DETERMINATION ($R^2$) | IMAGE DENSITIES AND EVALUATIONS | | | | TONER DEPOSITION AMOUNT AT IMAGE DENSITY 1.50 |
|---|---|---|---|---|---|---|---|---|---|---|---|
| | | L* | a* | b* | LINEAR FUNCTION | | 0.32 (mg/cm$^2$) | EVALU-ATION | 0.35 (mg/cm$^2$) | EVALU-ATION | (mg/cm$^2$) |
| EXAMPLE 16 | M-1 | 33.84 | 58.72 | 15.11 | y = 1.6509x + 1.0133 | $R^2$ = 0.9369 | 1.55 | EXCELLENT | 1.59 | EXCELLENT | 0.29 |
| EXAMPLE 17 | M-2 | 35.53 | 60.46 | 12.87 | y = 1.7500x + 0.9330 | $R^2$ = 0.9964 | 1.50 | EXCELLENT | 1.55 | EXCELLENT | 0.33 |
| EXAMPLE 18 | M-3 | 34.70 | 59.11 | 17.30 | y = 2.3110x + 0.7598 | $R^2$ = 0.8704 | 1.51 | EXCELLENT | 1.57 | EXCELLENT | 0.32 |
| EXAMPLE 19 | M-4 | 35.30 | 60.55 | 13.37 | y = 2.5685x + 0.6567 | $R^2$ = 0.9164 | 1.49 | GOOD | 1.56 | EXCELLENT | 0.33 |
| EXAMPLE 20 | M-5 | 34.28 | 59.11 | 15.81 | y = 2.4041x + 0.6861 | $R^2$ = 0.9610 | 1.46 | GOOD | 1.53 | EXCELLENT | 0.33 |
| EXAMPLE 21 | M-6 | 36.51 | 61.47 | 11.71 | y = 2.4735x + 0.6295 | $R^2$ = 0.9628 | 1.43 | GOOD | 1.50 | EXCELLENT | 0.35 |
| COMPARATIVE EXAMPLE 3 | M-7 | 38.61 | 63.71 | 7.35 | y = 2.0144x + 0.5429 | $R^2$ = 0.9453 | 1.19 | POOR | 1.25 | POOR | 0.48 |
| COMPARATIVE EXAMPLE 4 | M-8 | 39.68 | 63.48 | 5.95 | y = 1.6465x + 0.7540 | $R^2$ = 0.9057 | 1.29 | POOR | 1.33 | POOR | 0.45 |

FIG. 20

| EXAMPLE / COMPARATIVE EXAMPLE | BLACK TONER | POWDER COLOR | | | LINEAR APPROXIMATION | COEFFICIENT OF DETERMINATION ($R^2$) | IMAGE DENSITIES AND EVALUATIONS | | | | TONER DEPOSITION AMOUNT AT IMAGE DENSITY 1.50 |
|---|---|---|---|---|---|---|---|---|---|---|---|
| | | L* | a* | b* | LINEAR FUNCTION | | 0.29 (mg/cm$^2$) | EVALU-ATION | 0.35 (mg/cm$^2$) | EVALU-ATION | (mg/cm$^2$) |
| EXAMPLE 22 | K-1 | 11.14 | 0.00 | −0.27 | y = 1.8694x + 0.9647 | $R^2$ = 0.9338 | 1.51 | EXCELLENT | 1.62 | EXCELLENT | 0.29 |
| EXAMPLE 23 | K-2 | 10.59 | 0.12 | −0.22 | y = 2.3889x + 0.7979 | $R^2$ = 0.9399 | 1.50 | EXCELLENT | 1.62 | EXCELLENT | 0.30 |
| EXAMPLE 24 | K-3 | 11.01 | 0.16 | −0.39 | y = 2.0657x + 0.8965 | $R^2$ = 0.9460 | 1.50 | EXCELLENT | 1.62 | EXCELLENT | 0.29 |
| EXAMPLE 25 | K-4 | 11.13 | −0.01 | −0.52 | y = 2.3500x + 0.7782 | $R^2$ = 0.8735 | 1.47 | GOOD | 1.60 | EXCELLENT | 0.31 |
| EXAMPLE 26 | K-5 | 11.35 | 0.21 | −0.30 | y = 1.5364x + 1.0220 | $R^2$ = 0.9689 | 1.47 | GOOD | 1.56 | EXCELLENT | 0.31 |
| EXAMPLE 27 | K-6 | 11.08 | 0.19 | −0.14 | y = 1.8436x + 0.9216 | $R^2$ = 0.9125 | 1.46 | GOOD | 1.57 | EXCELLENT | 0.32 |
| COMPARATIVE EXAMPLE 5 | K-7 | 11.67 | 0.34 | 0.01 | y = 2.5119x + 0.5610 | $R^2$ = 0.9111 | 1.30 | POOR | 1.44 | GOOD | 0.37 |
| COMPARATIVE EXAMPLE 6 | K-8 | 12.87 | 0.31 | 0.01 | y = 2.4887x + 0.5278 | $R^2$ = 0.9787 | 1.26 | POOR | 1.40 | GOOD | 0.39 |

FIG. 21

| EXAMPLE COMPARATIVE EXAMPLE | YELLOW TONER | AVERAGE PRINT COLOR (R) | | | AVERAGE PRINT COLOR (Y) | | | AVERAGE PRINT COLOR (G) | | | COLOR DIFFERENCES AND EVALUATIONS | | | | | |
|---|---|---|---|---|---|---|---|---|---|---|---|---|---|---|---|---|
| | | | | | | | | | | | RED (R) | | YELLOW (Y) | | GREEN (G) | |
| | | L* | a* | b* | L* | a* | b* | L* | a* | b* | ΔE | EVALU-ATION | ΔE | EVALU-ATION | ΔE | EVALU-ATION |
| EXAMPLE 10 | Y-1 | 44.1 | 67.2 | 50.5 | 87.4 | -9.1 | 96.0 | 42.2 | -65.0 | 30.2 | 5.8 | EXCELLENT | 4.0 | EXCELLENT | 11.1 | EXCELLENT |
| EXAMPLE 11 | Y-2 | 45.6 | 67.1 | 50.0 | 88.0 | -6.8 | 96.6 | 43.0 | -62.2 | 29.8 | 4.9 | EXCELLENT | 3.2 | EXCELLENT | 12.2 | EXCELLENT |
| EXAMPLE 12 | Y-3 | 44.3 | 67.6 | 51.0 | 87.9 | -9.9 | 94.8 | 42.9 | -66.7 | 29.2 | 6.0 | EXCELLENT | 4.0 | EXCELLENT | 9.2 | EXCELLENT |
| EXAMPLE 13 | Y-4 | 44.1 | 67.1 | 51.1 | 87.2 | -8.5 | 94.7 | 42.6 | -65.4 | 30.2 | 6.3 | EXCELLENT | 2.9 | EXCELLENT | 10.7 | EXCELLENT |
| EXAMPLE 14 | Y-5 | 44.9 | 66.9 | 50.7 | 87.6 | -8.6 | 97.1 | 42.7 | -63.2 | 31.4 | 5.8 | EXCELLENT | 4.5 | EXCELLENT | 12.6 | EXCELLENT |
| EXAMPLE 15 | Y-6 | 44.9 | 67.1 | 53.1 | 87.6 | -8.1 | 95.7 | 42.4 | -65.0 | 31.1 | 7.9 | EXCELLENT | 3.0 | EXCELLENT | 11.6 | EXCELLENT |
| COMPARATIVE EXAMPLE 1 | Y-7 | 45.0 | 66.6 | 48.9 | 88.0 | -8.8 | 95.4 | 43.1 | -66.5 | 27.6 | 4.3 | EXCELLENT | 3.3 | EXCELLENT | 8.0 | EXCELLENT |
| COMPARATIVE EXAMPLE 2 | Y-8 | 43.2 | 70.5 | 51.1 | 87.8 | -8.9 | 95.5 | 41.4 | -69.6 | 27.2 | 6.6 | EXCELLENT | 3.5 | EXCELLENT | 8.0 | EXCELLENT |

FIG. 22

| EXAMPLE COMPARATIVE EXAMPLE | MAGENTA TONER | AVERAGE PRINT COLOR (R) | | | AVERAGE PRINT COLOR (M) | | | AVERAGE PRINT COLOR (B) | | | COLOR DIFFERENCES AND EVALUATIONS | | | | | |
|---|---|---|---|---|---|---|---|---|---|---|---|---|---|---|---|---|
| | | | | | | | | | | | RED (R) | | MAGENTA (M) | | BLUE (B) | |
| | | L* | a* | b* | L* | a* | b* | L* | a* | b* | ΔE | EVALU-ATION | ΔE | EVALU-ATION | ΔE | EVALU-ATION |
| EXAMPLE 16 | M-1 | 44.3 | 63.4 | 49.2 | 44.8 | 68.9 | -3.2 | 16.9 | 20.6 | -39.6 | 7.0 | EXCELLENT | 7.0 | EXCELLENT | 9.6 | EXCELLENT |
| EXAMPLE 17 | M-2 | 45.2 | 64.3 | 51.0 | 46.2 | 70.3 | -6.2 | 17.1 | 23.7 | -44.1 | 7.3 | EXCELLENT | 6.2 | EXCELLENT | 7.1 | EXCELLENT |
| EXAMPLE 18 | M-3 | 43.9 | 66.0 | 50.2 | 44.5 | 71.2 | 0.7 | 15.1 | 20.6 | -37.9 | 6.0 | EXCELLENT | 6.3 | EXCELLENT | 12.0 | EXCELLENT |
| EXAMPLE 19 | M-4 | 44.1 | 65.1 | 50.0 | 44.8 | 71.3 | -4.9 | 15.8 | 22.9 | -42.4 | 6.4 | EXCELLENT | 5.0 | EXCELLENT | 8.6 | EXCELLENT |
| EXAMPLE 20 | M-5 | 44.3 | 63.0 | 49.7 | 44.6 | 69.6 | -2.1 | 15.8 | 22.3 | -40.1 | 7.6 | EXCELLENT | 6.4 | EXCELLENT | 10.0 | EXCELLENT |
| EXAMPLE 21 | M-6 | 43.6 | 66.8 | 50.5 | 44.9 | 71.8 | -2.2 | 15.4 | 20.8 | -39.8 | 6.1 | EXCELLENT | 4.3 | EXCELLENT | 10.3 | EXCELLENT |
| COMPARATIVE EXAMPLE 3 | M-7 | 45.0 | 66.6 | 48.9 | 45.9 | 72.5 | -6.3 | 18.0 | 22.2 | -41.6 | 4.3 | EXCELLENT | 4.5 | EXCELLENT | 7.6 | EXCELLENT |
| COMPARATIVE EXAMPLE 4 | M-8 | 48.9 | 60.7 | 52.4 | 50.7 | 66.5 | -11.3 | 22.4 | 16.0 | -46.4 | 11.1 | EXCELLENT | 13.1 | EXCELLENT | 4.2 | EXCELLENT |

FIG. 23

| EXAMPLE COMPARATIVE EXAMPLE | BLACK TONER | AVERAGE PRINT COLOR (K) | | | COLOR DIFFERENCES AND EVALUATIONS | |
|---|---|---|---|---|---|---|
| | | | | | BLACK (K) | |
| | | L* | a* | b* | ΔE | EVALUATION |
| EXAMPLE 22 | K-1 | 20.7 | 1.1 | 0.7 | 1.4 | EXCELLENT |
| EXAMPLE 23 | K-2 | 20.5 | 1.3 | 0.9 | 1.2 | EXCELLENT |
| EXAMPLE 24 | K-3 | 19.1 | 1.5 | 0.3 | 2.2 | EXCELLENT |
| EXAMPLE 25 | K-4 | 20.4 | 1.0 | 0.3 | 1.8 | EXCELLENT |
| EXAMPLE 26 | K-5 | 20.0 | 0.7 | 2.4 | 1.4 | EXCELLENT |
| EXAMPLE 27 | K-6 | 19.9 | 1.2 | 0.8 | 1.5 | EXCELLENT |
| COMPARATIVE EXAMPLE 5 | K-7 | 20.6 | 1.9 | 1.9 | 0.0 | EXCELLENT |
| COMPARATIVE EXAMPLE 6 | K-8 | 19.3 | 2.0 | 2.3 | 1.4 | EXCELLENT |

FIG. 24

| EXAMPLE COMPARATIVE EXAMPLE | YELLOW TONER | IMAGE DENSITIES AND EVALUATIONS (FIG. 18) | | | | TONER DEPOSITION AMOUNT AT IMAGE DENSITY 1.50 (FIG. 18) | COLOR DIFFERENCES AND EVALUATIONS (FIG. 21) | | | | | | COMPREHENSIVE EVALUATION |
|---|---|---|---|---|---|---|---|---|---|---|---|---|---|
| | | | | | | | RED (R) | | YELLOW (Y) | | GREEN (G) | | |
| | | 0.31 (mg/cm$^2$) | EVALUATION | 0.35 (mg/cm$^2$) | EVALUATION | (mg/cm$^2$) | ΔE | EVALUATION | ΔE | EVALUATION | ΔE | EVALUATION | |
| EXAMPLE 10 | Y-1 | 1.53 | EXCELLENT | 1.61 | EXCELLENT | 0.30 | 5.8 | EXCELLENT | 4.0 | EXCELLENT | 11.1 | EXCELLENT | A |
| EXAMPLE 11 | Y-2 | 1.52 | EXCELLENT | 1.58 | EXCELLENT | 0.30 | 4.9 | EXCELLENT | 3.2 | EXCELLENT | 12.2 | EXCELLENT | A |
| EXAMPLE 12 | Y-3 | 1.50 | EXCELLENT | 1.55 | EXCELLENT | 0.32 | 6.0 | EXCELLENT | 4.0 | EXCELLENT | 9.2 | EXCELLENT | A |
| EXAMPLE 13 | Y-4 | 1.47 | GOOD | 1.54 | EXCELLENT | 0.33 | 6.3 | EXCELLENT | 2.9 | EXCELLENT | 10.7 | EXCELLENT | B |
| EXAMPLE 14 | Y-5 | 1.47 | GOOD | 1.55 | EXCELLENT | 0.33 | 5.8 | EXCELLENT | 4.5 | EXCELLENT | 12.6 | EXCELLENT | B |
| EXAMPLE 15 | Y-6 | 1.42 | GOOD | 1.52 | EXCELLENT | 0.34 | 7.9 | EXCELLENT | 3.0 | EXCELLENT | 11.6 | EXCELLENT | B |
| COMPARATIVE EXAMPLE 1 | Y-7 | 1.34 | POOR | 1.41 | GOOD | 0.40 | 4.3 | EXCELLENT | 3.3 | EXCELLENT | 8.0 | EXCELLENT | C |
| COMPARATIVE EXAMPLE 2 | Y-8 | 1.22 | POOR | 1.28 | POOR | 0.47 | 6.6 | EXCELLENT | 3.5 | EXCELLENT | 8.0 | EXCELLENT | C |

FIG. 25

| EXAMPLE / COMPARATIVE EXAMPLE | MAGENTA TONER | IMAGE DENSITIES AND EVALUATIONS (FIG. 19) | | | | TONER DEPOSITION AMOUNT AT IMAGE DENSITY 1.50 (FIG. 19) | COLOR DIFFERENCES AND EVALUATIONS (FIG. 22) | | | | | | COMPREHENSIVE EVALUATION |
|---|---|---|---|---|---|---|---|---|---|---|---|---|---|
| | | | | | | | RED (R) | | MAGENTA (M) | | BLUE (B) | | |
| | | 0.32 (mg/cm$^2$) | EVALUATION | 0.35 (mg/cm$^2$) | EVALUATION | (mg/cm$^2$) | ΔE | EVALUATION | ΔE | EVALUATION | ΔE | EVALUATION | |
| EXAMPLE 16 | M-1 | 1.55 | EXCELLENT | 1.59 | EXCELLENT | 0.29 | 7.0 | EXCELLENT | 7.0 | EXCELLENT | 9.6 | EXCELLENT | A |
| EXAMPLE 17 | M-2 | 1.50 | EXCELLENT | 1.55 | EXCELLENT | 0.33 | 7.3 | EXCELLENT | 6.2 | EXCELLENT | 7.1 | EXCELLENT | A |
| EXAMPLE 18 | M-3 | 1.51 | EXCELLENT | 1.57 | EXCELLENT | 0.32 | 6.0 | EXCELLENT | 6.3 | EXCELLENT | 12.0 | EXCELLENT | A |
| EXAMPLE 19 | M-4 | 1.49 | GOOD | 1.56 | EXCELLENT | 0.33 | 6.4 | EXCELLENT | 5.0 | EXCELLENT | 8.6 | EXCELLENT | B |
| EXAMPLE 20 | M-5 | 1.46 | GOOD | 1.53 | EXCELLENT | 0.33 | 7.6 | EXCELLENT | 6.4 | EXCELLENT | 10.0 | EXCELLENT | B |
| EXAMPLE 21 | M-6 | 1.43 | GOOD | 1.50 | EXCELLENT | 0.35 | 6.1 | EXCELLENT | 4.3 | EXCELLENT | 10.3 | EXCELLENT | B |
| COMPARATIVE EXAMPLE 3 | M-7 | 1.19 | POOR | 1.25 | POOR | 0.48 | 4.3 | EXCELLENT | 4.5 | EXCELLENT | 7.6 | EXCELLENT | C |
| COMPARATIVE EXAMPLE 4 | M-8 | 1.29 | POOR | 1.33 | POOR | 0.45 | 11.1 | EXCELLENT | 13.1 | EXCELLENT | 4.2 | EXCELLENT | C |

FIG. 26

| EXAMPLE / COMPARATIVE EXAMPLE | BLACK TONER | IMAGE DENSITIES AND EVALUATIONS (FIG. 20) | | | | TONER DEPOSITION AMOUNT AT IMAGE DENSITY 1.50 (FIG. 20) | COLOR DIFFERENCES AND EVALUATIONS (FIG. 23) BLACK (K) | | COMPREHENSIVE EVALUATION |
|---|---|---|---|---|---|---|---|---|---|
| | | 0.29 (mg/cm$^2$) | EVALUATION | 0.35 (mg/cm$^2$) | EVALUATION | (mg/cm$^2$) | ΔE | EVALUATION | |
| EXAMPLE 22 | K-1 | 1.51 | EXCELLENT | 1.62 | EXCELLENT | 0.29 | 1.4 | EXCELLENT | A |
| EXAMPLE 23 | K-2 | 1.50 | EXCELLENT | 1.62 | EXCELLENT | 0.30 | 1.2 | EXCELLENT | A |
| EXAMPLE 24 | K-3 | 1.50 | EXCELLENT | 1.62 | EXCELLENT | 0.29 | 2.2 | EXCELLENT | A |
| EXAMPLE 25 | K-4 | 1.47 | GOOD | 1.60 | EXCELLENT | 0.31 | 1.8 | EXCELLENT | B |
| EXAMPLE 26 | K-5 | 1.47 | GOOD | 1.56 | EXCELLENT | 0.31 | 1.4 | EXCELLENT | B |
| EXAMPLE 27 | K-6 | 1.46 | GOOD | 1.57 | EXCELLENT | 0.32 | 1.5 | EXCELLENT | B |
| COMPARATIVE EXAMPLE 5 | K-7 | 1.30 | POOR | 1.44 | GOOD | 0.37 | 0.0 | EXCELLENT | C |
| COMPARATIVE EXAMPLE 6 | K-8 | 1.26 | POOR | 1.40 | GOOD | 0.39 | 1.4 | EXCELLENT | C |

FIG. 27

| | | AVERAGE PRINT COLOR | | | COLOR DIFFERENCE | EVALUATION OF PRINT COLOR |
|---|---|---|---|---|---|---|
| | AVERAGE IMAGE DENSITY | L* | a* | b* | ΔE | |
| CYAN (C) | 1.51 | 46.5 | −26.3 | −50.6 | 12.1 | EXCELLENT |
| YELLOW (Y) | 1.53 | 87.8 | −9.0 | 97.2 | 4.6 | EXCELLENT |
| MAGENTA (M) | 1.47 | 45.1 | 69.3 | −3.8 | 6.6 | EXCELLENT |
| RED (R) | 1.75 | 43.8 | 64.7 | 49.5 | 6.4 | EXCELLENT |
| GREEN (G) | 1.66 | 38.4 | −61.7 | 24.4 | 13.1 | EXCELLENT |
| BLUE (B) | 1.78 | 16.1 | 20.1 | −39.1 | 10.4 | EXCELLENT |

TONER CONTAINER, IMAGE FORMING UNIT, AND IMAGE FORMING APPARATUS

CROSS REFERENCE TO RELATED APPLICATIONS

This application is a continuation application of U.S. patent application Ser. No. 16/656,713, filed on Oct. 18, 2019, which claims the benefit of priority to Japanese Patent Application No. 2018-221275, filed on Nov. 27, 2018, and Japanese Patent Application No. 2019-157723, filed on Aug. 30, 2019. The entire contents of the applications are hereby incorporated herein by reference.

BACKGROUND OF THE INVENTION

1. Field of the Invention

The present invention relates to a toner container, an image forming unit, and an image forming apparatus.

2. Description of the Related Art

In recent years, as image forming apparatuses that form images by using electrophotographic processes have become more common, their uses have become more varied, and requirements for image density or vividness have become more strict.

For example, there is provided an image forming apparatus that obtains a surface roughness of a medium as information regarding the surface structure of the medium, and increases the amount of toner deposited on the medium as the surface roughness of the medium increases, in order to form images at a constant density (see Japanese Patent Application Publication No. 2004-258397).

However, increase in the amount of toner deposited on the medium degrades color mixing performance when an image is formed by superimposing toners of different colors, degrading color reproducibility. Also, increase in the amount of toner deposited on the medium increases the amount of toner required, increasing the size of a toner container storing the toner.

SUMMARY OF THE INVENTION

An aspect of the present invention is intended to provide a toner container, an image forming unit, and an image forming apparatus capable of forming an image with sufficient density and high color reproducibility while reducing use of toner.

According to an aspect of the present invention, there is provided a toner container used in an image forming apparatus including an exposure unit with a light emitting diode light source. The toner container includes: a container body; and a cyan toner stored in the container body. A lightness L*, a hue a*, and a hue b* of the cyan toner in a powder state satisfy $$26.94 \le L^* \le 34.84,$$

$$-5.13 \le a^* \le 3.83, \text{ and}$$

$$-47.47 \le b^* \le -36.78.$$

According to another aspect of the present invention, there is provided an image forming apparatus including: a cyan toner, a lightness L*, a hue a*, and a hue b* of the cyan toner in a powder state satisfying $$26.94 \le L^* \le 34.84,$$

$$-5.13 \le a^* \le 3.83, \text{ and}$$

$$-47.47 \le b^* \le -36.78;$$

an electrostatic latent image carrier having a surface on which an electrostatic latent image is formed; an exposure unit that forms the electrostatic latent image on the electrostatic latent image carrier; a toner carrier that develops the electrostatic latent image with the cyan toner to form a toner image; a transfer unit that transfers the toner image onto a medium; and a fixing device that fixes the toner image to the medium to form a printed product.

BRIEF DESCRIPTION OF THE DRAWINGS

In the attached drawings:

FIGS. 11 to 27 are tables showing results of measurements and evaluations.

DETAILED DESCRIPTION OF THE INVENTION

Embodiments of the present invention will now be described in detail with reference to the attached drawings. A color printer serving as an image forming apparatus will be described.

Figure 1:
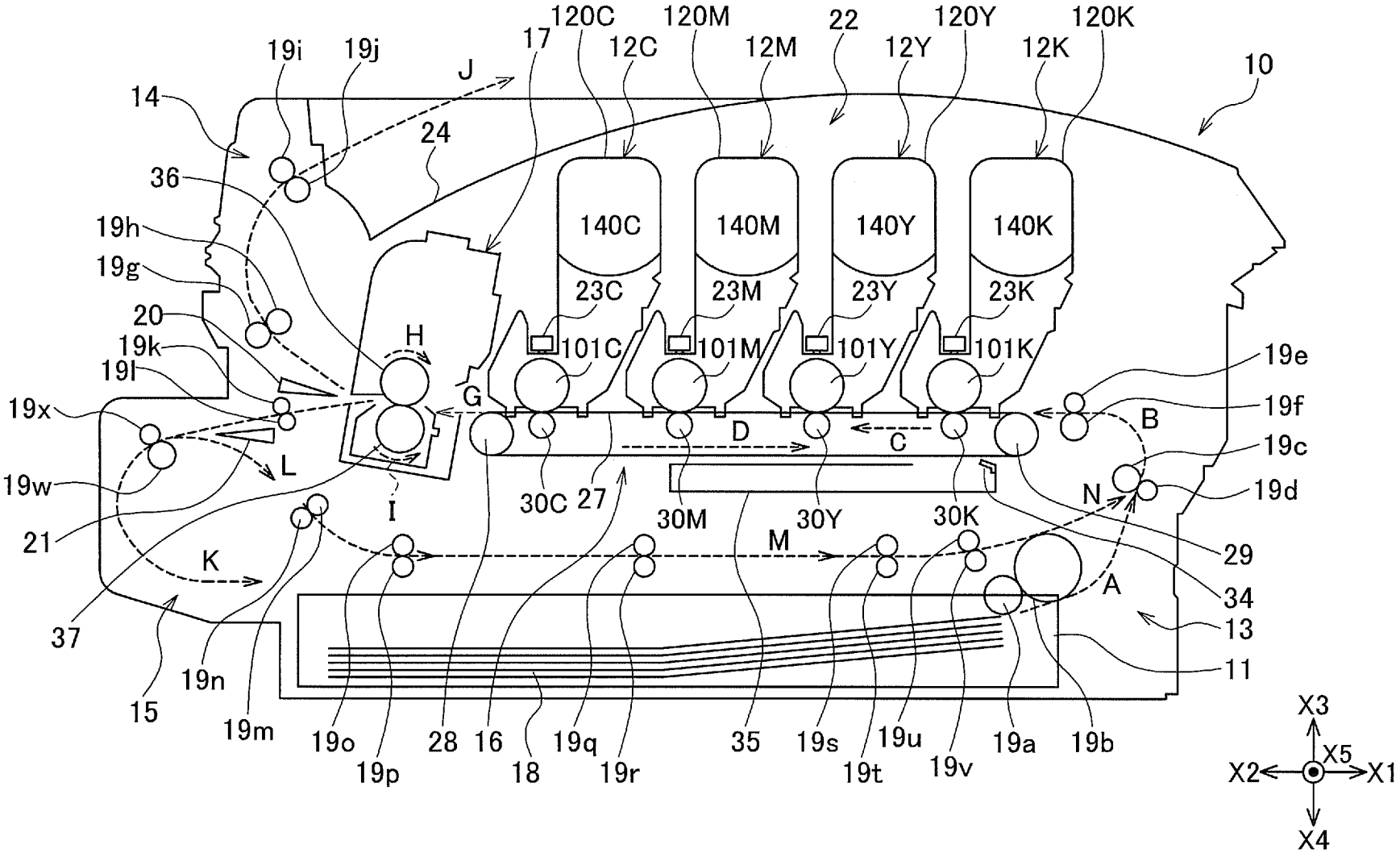
FIG. 1 is a conceptual diagram of a printer of a first embodiment of the present invention.
Figure 3:
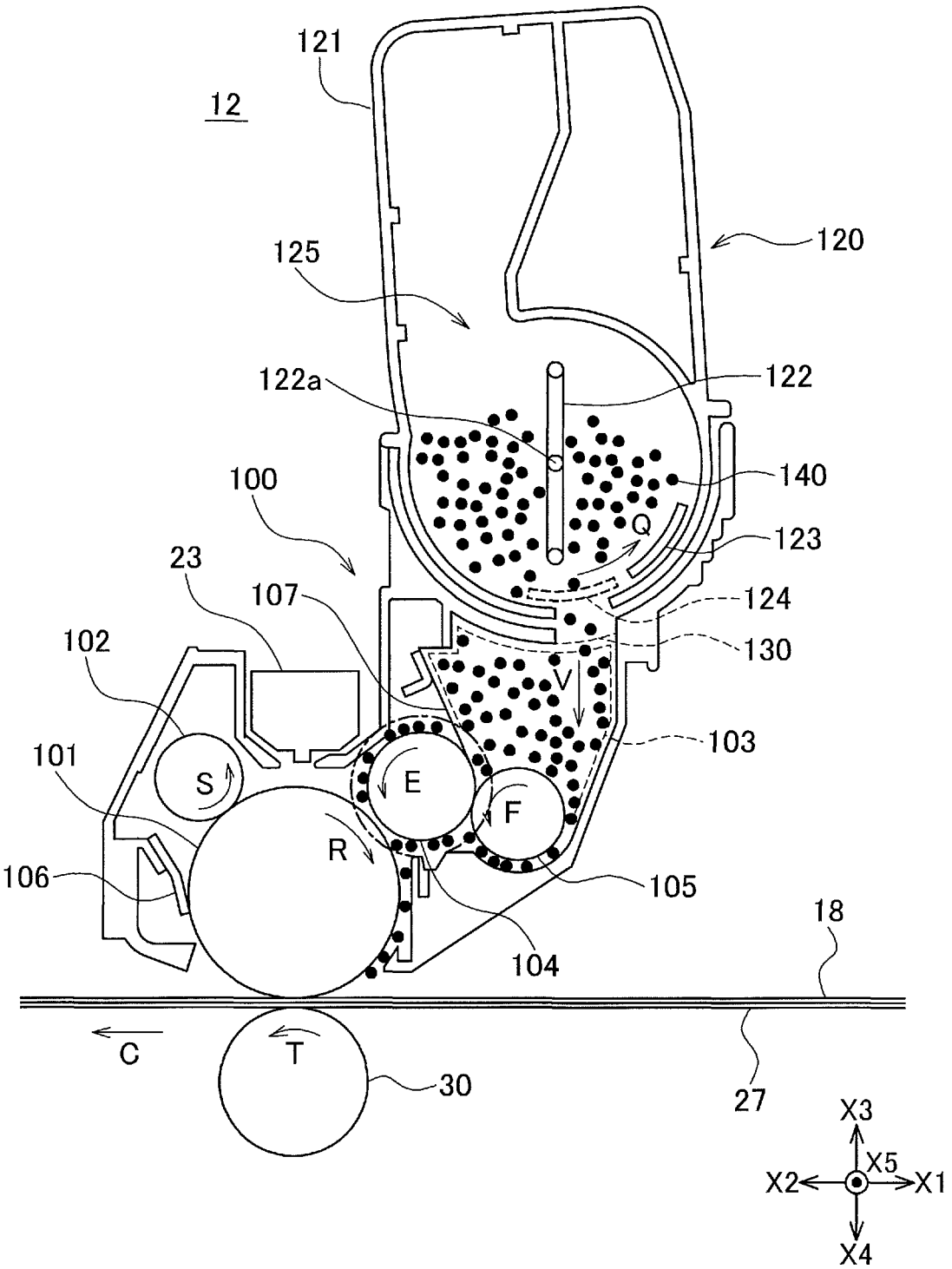
FIG. 3 is a sectional view of the image forming unit of the first embodiment of the present invention.
Figure 4:
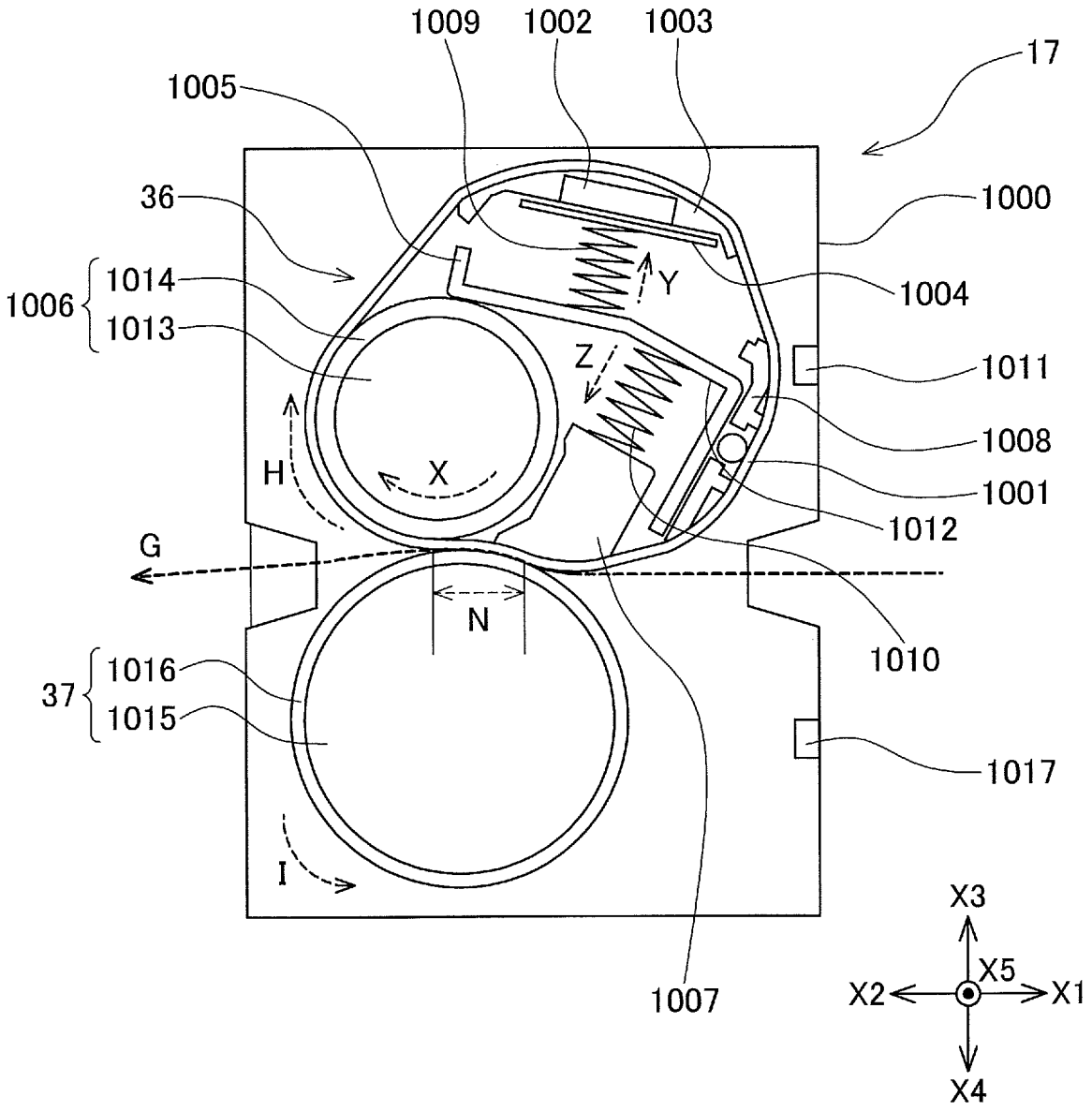
FIG. 4 is a sectional view illustrating main components of a fixing device of the first embodiment of the present invention.

FIG. 1 is a conceptual diagram of a printer 10 of a first embodiment of the present invention. The right side of FIG. 1 is assumed to be the front side of the printer 10. In FIGS. 1, 2A, 2B, 3, and 4, the forward, rearward, upward, downward, leftward, and rightward directions when the printer 10 is viewed from the front side are indicated by arrows X1, X2, X3, X4, X5, and X6, respectively. It is assumed that the front and back sides of the drawing sheets of FIGS. 1, 3, and 4 are the left and right sides of the printer 10, respectively. It is also assumed that the left-right direction is a main scanning direction and the front-rear direction is a sub-scanning direction.

In FIG. 1, the printer 10 is an electrophotographic printer capable of forming and printing black, yellow, magenta, and cyan images with black toner 140K serving as black developer, yellow toner 140Y serving as yellow developer, magenta toner 140M serving as magenta developer, and cyan toner 140C serving as cyan developer. When the black, yellow, magenta, and cyan toners need not be distinguished from each other, they may be referred to as toner 140.

The printer 10 includes a sheet feed cassette 11 serving as a medium container that stores media 18, such as plain paper sheets or film sheets, a medium feeding unit 13 that feeds a medium 18 from the sheet feed cassette 11 to an image forming portion 22, a fixing device (or fixing unit) 17 that fixes a toner image as a developer image transferred on the medium 18, a medium discharging unit 14 that discharges the medium 18 from the fixing device 17 to the outside of the printer 10, a reconveying unit 15 that feeds the medium 18 again to the image forming portion 22 and fixing device 17 for duplex printing, and other components.

The image forming portion 22 includes image forming units 12K, 12Y, 12M, and 12C, and light-emitting diode (LED) heads 23K, 23Y, 23M, and 23C (serving as exposure means and exposure devices) using LEDs as light sources. When the LED heads 23K, 23Y, 23M, and 23C need not be distinguished from each other, they may be referred to as the LED heads 23.

The sheet feed cassette 11 stores media 18 used for printing and is detachably disposed at a lower portion of the printer 10. The sheet feed cassette 11 stores the media 18 in a stacked manner. The media 18 stored in the sheet feed cassette 11 are fed one by one from the uppermost medium and conveyed on a medium conveying path that is a conveying path for the media 18 as indicated by arrow A, by a pickup roller 19*a* and feeder roller 19*b* disposed above the sheet feed cassette 11. Then, the medium 18 is conveyed as indicated by arrow B by conveying rollers (including registration rollers) 19*c*, 19*d*, 19*e*, and 19*f* and conveyed to the image forming portion 22 in which the image forming units 12K, 12Y, 12M, and 12C are disposed. The conveying rollers 19*e* and 19*f* correct skew of the medium 18 conveyed by the conveying rollers 19*c* and 19*d*.

The image forming units 12K, 12Y, 12M, and 12C respectively form toner images with the black toner 140K, yellow toner 140Y, magenta toner 140M, and cyan toner 140C, and are attachable to and detachable from the image forming portion 22 in the printer 10. The configurations of the image forming units 12K, 12Y, 12M, and 12C will be described later.

The image forming unit 12K with a toner cartridge 120K storing the black toner 140K attached thereto, the image forming unit 12Y with a toner cartridge 120Y storing the yellow toner 140Y attached thereto, the image forming unit 12M with a toner cartridge 120M storing the magenta toner 140M attached thereto, and the image forming unit 12C with a toner cartridge 120C storing the cyan toner 140C attached thereto are aligned along the medium conveying path from the front side toward the rear side. When the toner cartridges 120K, 120Y, 120M, and 120C need not be distinguished from each other, they may be referred to as the toner cartridges 120.

The image forming units 12K, 12Y, 12M, and 12C have the same configuration except that the colors of the toners 140 stored in the toner cartridges 120 serving as toner containers are different. Thus, when the image forming units 12K, 12Y, 12M, and 12C need not be distinguished from each other, they may be referred to as the image forming units 12.

A transfer unit 16 serving as a transfer device is disposed to transfer a toner image formed by the image forming unit 22 onto the medium 18.

The transfer unit 16 includes a transfer belt 27 that electrostatically attracts and conveys the medium 18, a drive roller 28 and a tension roller 29 around which the transfer belt 27 is stretched, transfer rollers 30K, 30Y, 30M, and 30C serving as transfer members disposed to face photosensitive drums 101K, 101Y, 101M, and 101C serving as image carriers and electrostatic latent image carriers of the image forming units 12K, 12Y, 12M, and 12C, a transfer belt cleaning blade 34 serving as a cleaning member that scrapes off toner 140 remaining on the transfer belt 27 after the transfer of the toner image to clean the transfer belt 27, a waste toner tank 35 serving as a waste developer collection portion that stores the scraped toner 140, and other components.

When the photosensitive drums 101K, 101Y, 101M, and 101C need not be distinguished from each other, they may be referred to as the photosensitive drums 101.

The drive roller 28 is rotated by a belt drive motor 60 (see FIG. 5) to be described later to move the transfer belt 27 in the directions of arrows C and D.

The tension roller 29 applies a predetermined tension to the transfer belt 27.

The transfer belt 27 attracts the medium 18 to its surface, is moved by rotation of the drive roller 28, and conveys the medium 18 along the image forming units 12K, 12Y, 12M, and 12C.

The photosensitive drums 101K, 101Y, 101M, and 101C of the image forming units 12K, 12Y, 12M, and 12C are pressed against the transfer rollers 30K, 30Y, 30M, and 30C via the transfer belt 27, and nip the medium 18. The image forming units 12K, 12Y, 12M, and 12C convey the medium 18 to the fixing device 17. The transfer rollers 30K, 30Y, 30M, and 30C are applied with transfer voltages for transferring toner images formed on surfaces of the respective photosensitive drums 101 onto the medium 18.

When the transfer rollers 30K, 30Y, 30M, and 30C need not be distinguished from each other, they may be referred to as the transfer rollers 30.

The fixing device 17 is disposed downstream (to the left in FIG. 1) of the image forming portion 22 in the conveying direction of the medium 18. The fixing device 17 fixes the transferred toner image to the medium 18. The fixing device 17 includes a heating belt unit 36 serving as a heating member and fixing member, and a pressure roller 37 serving as a pressure member.

A switching guide 20 that switches the conveying path of the medium 18 to which the toner image has been fixed by the fixing device 17 is disposed. The switching guide 20 conveys the medium 18 passing through the fixing device 17 selectively to the medium discharging unit 14 or to the reconveying unit 15.

The medium discharging unit 14 includes discharging rollers 19*g*, 19*h*, 19*i*, and 19*j* for discharging the medium 18 fed from the fixing device 17 to the outside of the printer 10. A stacking portion 24 on which the medium 18 discharged by the medium discharging unit 14 is placed is provided in an upper cover of the printer 10.

The reconveying unit 15 includes a retreat path into which the medium 18 conveyed through the switching guide 20 is caused to temporarily retreat in the direction of arrow K, conveying rollers 19*k*, 191, 19*w*, 19*x* that convey the medium 18 in the retreat path, a switching guide 21 that switches the direction of the medium 18 caused to retreat to the direction of arrow L, conveying rollers 19*m*, 19*n*, 19*o*,

19*p*, 19*q*, 19*r*, 19*s*, 19*t*, 19*u*, 19*v* that convey the medium 18 along a return path in the direction of arrow M to the medium feeding unit 13, and other components.

The conveying rollers 19*c* and 19*d* are disposed at an exit of the return path, and the medium 18, which is inverted, is conveyed in the direction of arrow N and refed to the image forming portion 22.

The image forming units 12 will now be described.

The image forming units 12K, 12Y, 12M, and 12C perform development using the black toner 140K, yellow toner 140Y, magenta toner 140M, and cyan toner 140C to form black, yellow, magenta, and cyan toner images, respectively.

As aforementioned, the image forming units 12K, 12Y, 12M, and 12C have the same configuration except for the colors of the toners stored in the toner cartridges 120. Thus, when the image forming units 12K, 12Y, 12M, and 12C need not be distinguished from each other, they may be referred to as the image forming units 12.

Figure 2A:
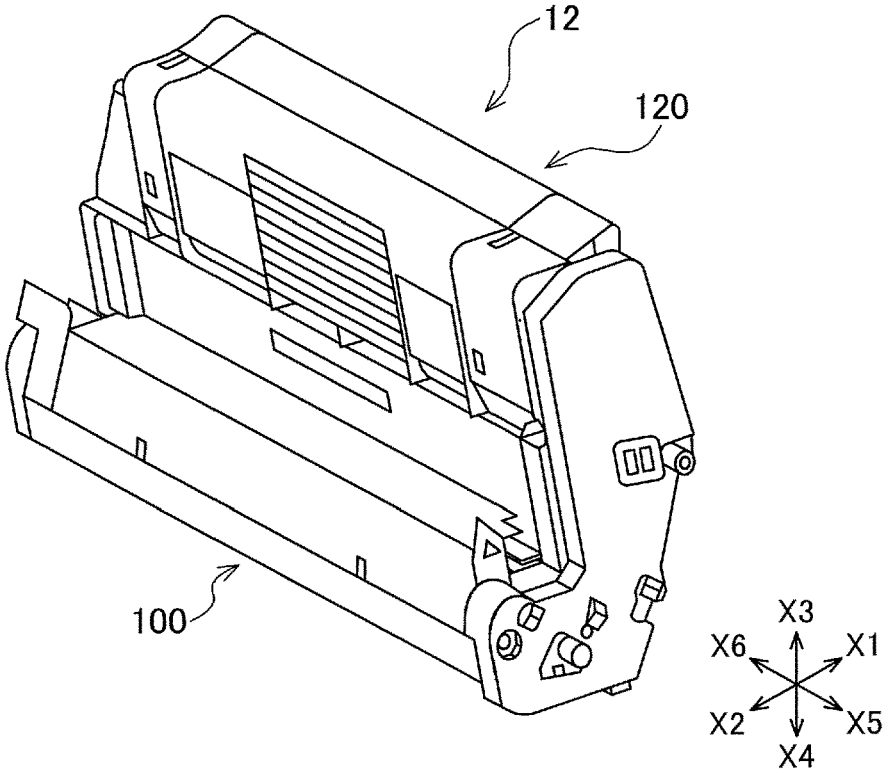
FIGS. 2A and 2B are views illustrating an image forming unit of the first embodiment of the present invention.
Figure 2B:
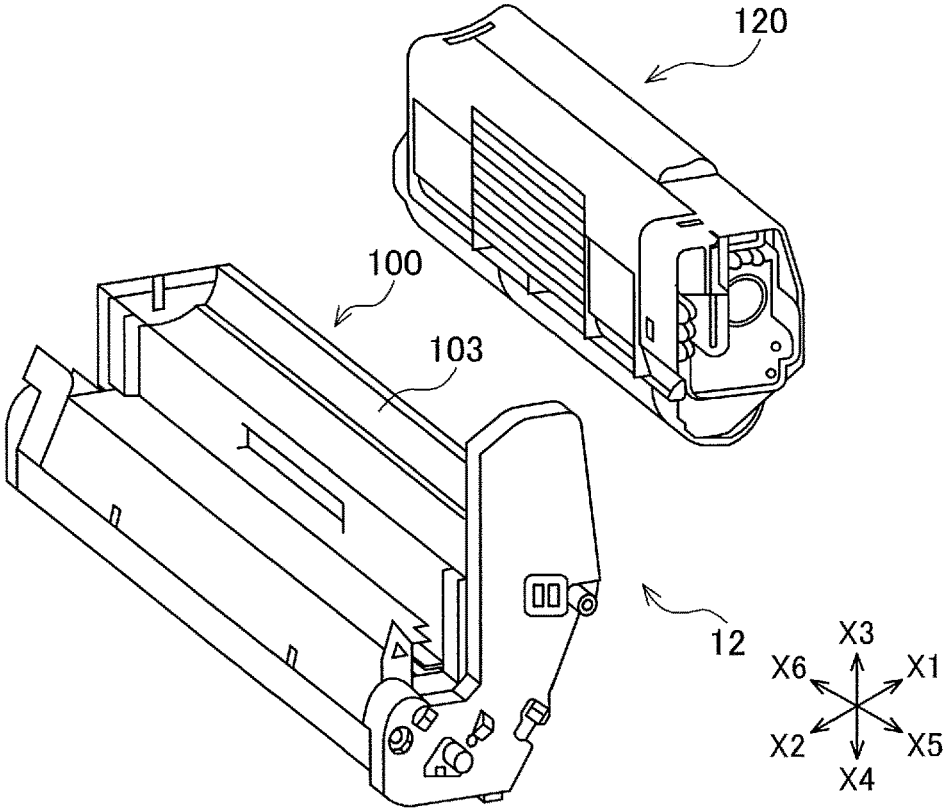

FIGS. 2A and 2B are views illustrating an image forming unit 12 of the first embodiment of the present invention. FIG. 2A is a perspective view of the image forming unit 12, and FIG. 2B is a view of the image forming unit 12 with the toner cartridge 120 separated from a process portion 100. FIG. 3 is a sectional view of the image forming unit 12 of the first embodiment of the present invention. FIG. 3 also illustrates the LED head 23, transfer roller 30, and transfer belt 27.

The image forming unit 12 includes the process portion 100 that develops a toner image of the corresponding color, and the toner cartridge 120 that stores the toner 140 and is detachably attached to the process portion 100. The toner cartridge 120 includes a container body 121, and the toner 140 is stored in the container body 121. By attaching the toner cartridge 120 to the process portion 100, the toner 140 stored in a toner storage portion 125 serving as a storage space of the toner cartridge 120 is supplied to a toner holding portion 103 serving as a developer holding portion of the process portion 100. The process portion 100 forms a toner image using the toner 140 supplied from the toner cartridge 120.

The process portion 100 includes the photosensitive drum 101, a charging roller 102 serving as a charging member, a developing roller 104 serving as a toner carrier and developer carrier, a supply roller 105 serving as a supply member, a developing blade 107 serving as a layer regulating member, a cleaning blade 106 serving as a cleaning member, and other components.

The photosensitive drum 101 is a substantially cylindrical member extending in a longitudinal direction (or the main scanning direction), and is rotated in the direction of arrow R.

The cleaning blade 106 is disposed parallel to a rotational axis of the photosensitive drum 106, and disposed with its edge abutting the surface of the photosensitive drum 101.

The charging roller 102 is disposed to abut the surface of the photosensitive drum 101, and rotated in a direction (indicated by arrow S) opposite to the rotation direction of the photosensitive drum 101.

The LED head 23 includes LED elements serving as LED light sources and a lens array. The LED head 23 is positioned so that light emitted from the LED elements is imaged onto the surface of the photosensitive drum 101. The LED head 23 is driven and controlled by an LED head controller 53 (see FIG. 5) to be described later to emit light according to image information.

The developing roller 104 is disposed to abut the surface of the photosensitive drum 101, and rotated in a direction (indicated by arrow E) opposite to the rotation direction of the photosensitive drum 101.

The supply roller 105 is disposed to abut a surface of the developing roller 104, and rotated in a direction (indicated by arrow F) identical to the rotation direction of the developing roller 104.

The developing blade 107 is disposed to face counter to the rotation direction of the developing roller 104 and regulate the layer thickness of the toner 140 supplied from the supply roller 105 to the developing roller 104.

The toner holding portion (also referred to as the toner hopper, toner supply portion, or the like) 103 has a region surrounded by an outer peripheral surface of the supply roller 105, an outer peripheral surface of the developing roller 104, a surface of the developing blade 107, and an inner surface of the process portion 100. In the process portion 100, an opening portion 130 through which the toner 140 is received from the toner cartridge 120 is formed above the toner holding portion 103. The toner 140 in the toner cartridge 120 falls and is supplied into the toner holding portion 103 through the opening portion 130 as indicated by arrow V.

The toner cartridge 120 includes the toner storage portion 125 that stores the toner 140, and extends in the longitudinal direction of the photosensitive drum 101. An agitating bar 122 that agitates the toner 140 is disposed in the toner storage portion 125.

The agitating bar 122 is supported rotatably about a rotational shaft 122*a* extending in a longitudinal direction of the toner cartridge 120. An outlet 124 for discharging the toner 140 stored in the toner storage portion 125 and a shutter 123 for opening and closing the outlet 124 are disposed below the agitating bar 122. The shutter 123 is disposed slidably in the direction of arrow Q along an inner peripheral surface of the toner storage portion 125.

The fixing device 17 will now be described.

FIG. 4 is a sectional view illustrating main components of the fixing device 17 of the first embodiment of the present invention.

The fixing device 17 includes the heating belt unit 36 disposed above a medium conveying path G, the pressure roller 37 disposed below the medium conveying path G, and other components.

A fixing device exterior (or frame) 1000 has a rectangular parallelepiped shape, and has front and rear sides having openings formed at their center portions to pass through them in the front-rear direction. The heating belt unit 36 and pressure roller 37 are disposed in the fixing device exterior 1000. Also, the fixing device exterior 1000 has left and right sides in which multiple holes, such as insertion holes for inserting parts of the heating belt unit 36 and shaft holes for rotatably supporting the pressure roller 37, are formed as needed.

As illustrated in FIG. 4, the heating belt unit 36 includes an annular fixing belt 1001, and also includes a plate heater 1002 serving as a heating element, a heat transfer member 1003, a heat diffusion member 1004, a support member 1005, a fixing roller 1006, a pressure pad 1007, a guide member 1008, and coil springs 1009 and 1010, which are disposed in a space surrounded by the fixing belt 1001.

The pressure roller 37 includes a metal core 1015 and an elastic layer 1016 covering a periphery of the metal core 1015, and is disposed to face the fixing roller 1006 and pressure pad 1007 via the fixing belt 1001. Both ends of the metal core 1015 are rotatably supported by pressure roller support members (not illustrated). The pressure roller 37, and the metal core 1015 and elastic layer 1016 are all disposed to extend in a longitudinal direction.

The fixing belt 1001 is an annular (or endless) belt stretched with a predetermined tension by the heat transfer member 1003, fixing roller 1006, pressure pad 1007, and guide member 1008, and is supported rotatably in the direction of arrow H.

For example, the fixing belt 1001 has an inner diameter of about 45 mm, and has a three-layer structure including an inner layer made of polyimide and having a thickness of 0.1 mm, an intermediate layer made of silicone rubber and having a thickness of 0.2 mm, and an outer layer made of fluorine resin, such as polytetrafluoroethylene (PTFE) or perfluoroalkoxy alkane (PFA).

A nip portion N is formed between the fixing roller 1006 and pressure pad 1007 and the pressure roller 37 in such a manner that the fixing belt 1001 and pressure roller 37 are pressed against each other. The medium 18 is conveyed between the fixing belt 1001 and the pressure roller 37 in the direction of arrow G, and a toner image is fixed to the medium 18 in the nip portion N. A nip width of the nip portion N in the sub-scanning direction is set to 10 to 11 mm, and a total pressing force at the nip portion N is set to 18 to 20 kgf.

The plate heater 1002 is a plate-shaped member extending in a lateral direction (or the left-right direction), and is a heat source that heats the fixing belt 1001. The plate heater 1002 abuts the heat transfer member 1003 and heat diffusion member 1004 that surround the plate heater 1002. Thereby, heat is transferred from the plate heater 1002 to the fixing belt 1001 through the heat transfer member 1003 and heat diffusion member 1004.

The plate heater 1002 includes resistance wire as a heating element, and the resistance wire is supplied with current from an external power source and control circuit at appropriate timings, thereby generating heat. For example, the plate heater 1002 has a structure in which resistance wire made of a mixture of Ag (silver) and Pd (palladium) is disposed on a substrate made of stainless steel and having a dimension of 350 mm in a longitudinal direction along the lateral direction, a dimension of 10 mm in a transverse direction perpendicular to the lateral direction, and a thickness of 1 mm. The resistance wire has an output of, for example, 1000 W.

The heat transfer member 1003 is, for example, a member that is made of aluminum or extruded aluminum alloy (JIS A6063) and has a substantially cylindrical shape extending along the plate heater 1002 with the lateral direction as its longitudinal direction. The heat transfer member 1003 transfers heat generated by the plate heater 1002 to the fixing belt 1001.

The heat diffusion member 1004 is a member having a substantially flat plate shape and extending in the lateral direction along the plate heater 1002 and heat transfer member 1003. The heat diffusion member 1004 diffuses heat generated by the plate heater 1002 in the direction of arrow H of the fixing belt 1001 and transfers it to the heat transfer member 1003.

It is possible to place, between the plate heater 1002 and the heat transfer member 1003 and between the plate heater 1002 and the heat diffusion member 1004, semisolid grease or the like having high heat resistance and high heat conductivity and being deformable to any shape. The heat diffusion member 1004 also functions as a pressure member that receives an urging force from the coil spring 1009 serving as an urging member to press the inner peripheral surface of the fixing belt 1001. It is preferable that a plurality of the coil springs 1009 be arranged along the longitudinal direction of the heat diffusion member 1004 (or the main scanning direction).

The support member 1005 extends in a longitudinal direction (or the main scanning direction), like the plate heater 1002, heat transfer member 1003, heat diffusion member 1004, and the like. Both ends of the support member 1005 in the longitudinal direction (or main scanning direction) are fixed to a pair of side plates (not illustrated). The support member 1005 holds the guide member 1008.

The coil spring 1009 is disposed between the support member 1005 and the plate heater 1002. The coil spring 1009 generates the urging force, which urges the heat diffusion member 1004 in the direction of arrow Y away from the support member 1005.

The heat transfer member 1003 receives the urging force from the coil spring 1009 through the heat diffusion member 1004 and plate heater 1002, abuts the inner peripheral surface of the fixing belt 1001, and presses the fixing belt 1001 outward. Thus, the urging force of the coil spring 1009 is transmitted to the fixing belt 1001 through the plate heater 1002, heat transfer member 1003, and heat diffusion member 1004. In this manner, the fixing belt 1001 is stretched by being pressed outward by the heat transfer member 1003.

The coil spring 1010 serving as an urging member is disposed between the support member 1005 and the pressure pad 1007. The coil spring 1010 has an end that abuts the pressure pad 1007 and another end that abuts a back side 1012 of the support member 1005, and generates an urging force that urges the pressure pad 1007 in the direction of arrow Z away from the support member 1005.

The pressure pad 1007 receives the urging force from the coil spring 1010, abuts the inner peripheral surface of a part of the fixing belt 1001 stretched between the guide member 1008 and the fixing roller 1006, and presses the fixing belt 1001 outward. Thus, the urging force of the coil spring 1010 is transmitted to the fixing belt 1001 through the pressure pad 1007. In this manner, the fixing belt 1001 is also stretched by being pressed outward by the pressure pad 1007.

The guide member 1008 is fixed to the support member 1005, and guides travel of the fixing belt 1001 by a part of the guide member 1008 abutting the inner peripheral surface of the fixing belt 1001.

The fixing roller 1006 includes a metal core 1013 extending in a longitudinal direction (or the main scanning direction), and an elastic layer 1014 covering a periphery of the metal core 1013. A fixing gear (not illustrated) is attached to one end of the metal core 1013. Rotation is transmitted from a fixing motor 61 (see FIG. 5) to be described later to the fixing gear, thereby rotating the fixing roller 1006 in the direction of arrow X.

The fixing roller 1006 has a surface of the elastic layer 1014 abutting the inner peripheral surface of the fixing belt 1001, thereby moving the fixing belt 1001 in the direction of arrow H and guiding the movement. For example, the fixing roller 1006 has an outer diameter of about 20 mm, and the elastic layer 1014 is made of silicone sponge and has a thickness of 2 mm.

The pressure roller 37 moves the fixing belt 1001 sandwiched between the pressure roller 37 and the fixing roller 1006, in the direction of arrow I. For example, the pressure roller 37 has an outer diameter of about 34 mm, and the elastic layer 1016 is made of silicone sponge and has a thickness of 2 mm. The pressure roller 37 may further include, on the elastic layer 1016, an outer layer made of fluorine resin, such as PFA.

As above, rotation is transmitted from the fixing motor 61 to the fixing device 17, so that the fixing roller 1006 is rotated in the direction of arrow X in the nip portion N, and a frictional force is generated between the fixing roller 1006 and the fixing belt 1001, moving the fixing belt 1001 in the direction of arrow H. The pressure roller 37 is also rotated in the direction of arrow I in accordance with the rotation of the fixing roller 1006. At this time, when a medium 18 is conveyed along the medium conveying path G, the fixing device 17 applies heat and pressure to the medium 18.

A temperature sensor 1011 is disposed at a center of the fixing belt 1001 of the heating belt unit 36 in the longitudinal direction (or main scanning direction) to face the fixing belt 1001. The temperature sensor 1011 detects a temperature of a surface of the fixing belt 1001 before the surface enters the nip portion N. Also, a temperature sensor 1017 is disposed at a center of the pressure roller 37 in the longitudinal direction (or main scanning direction) to face the pressure roller 37. The temperature sensor 1017 detects a temperature of a surface of the elastic layer 1016 of the pressure roller 37 before the medium 18 is fed to the nip portion N.

Next, a control device of the printer 10 will be described.

Figure 5:
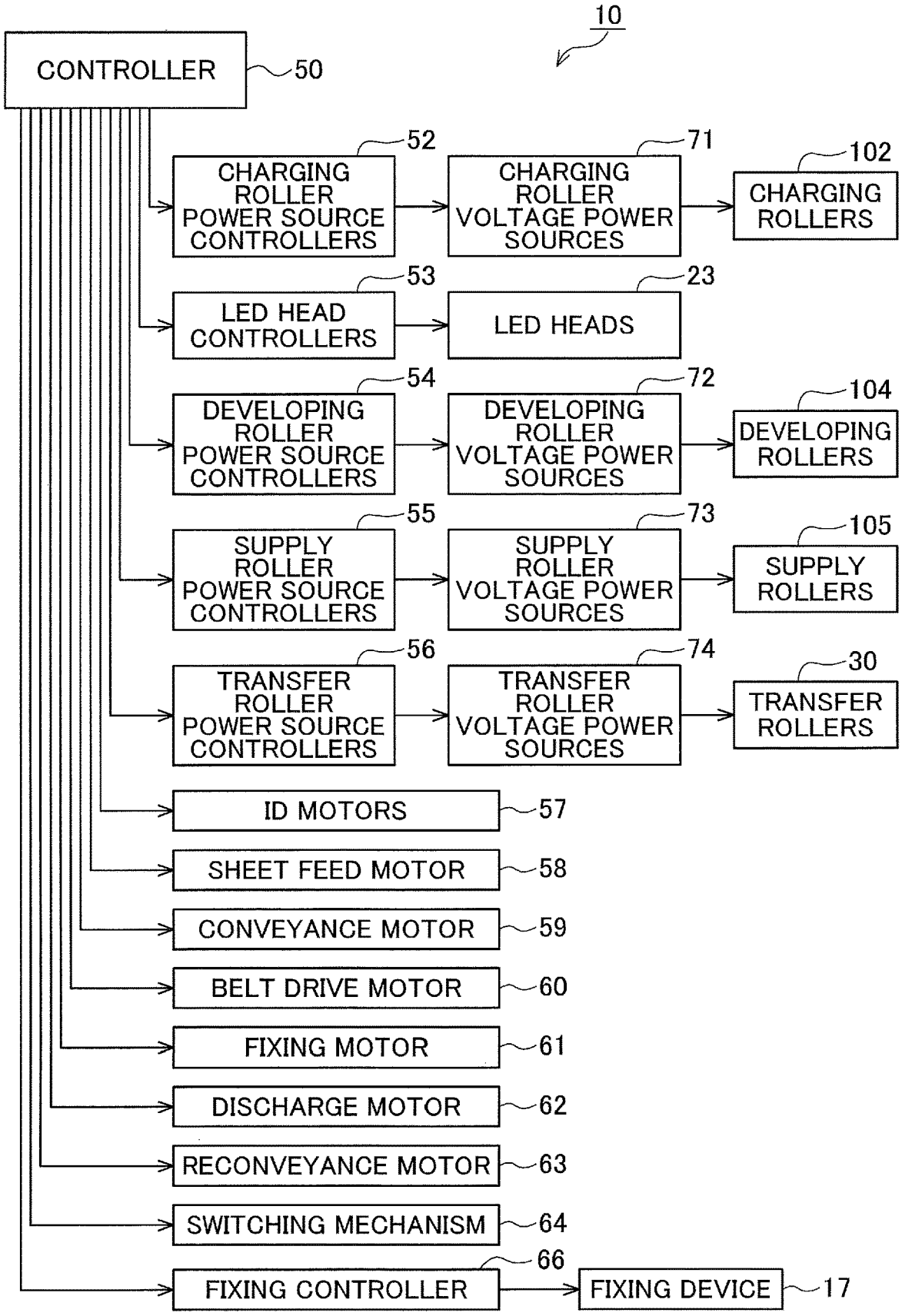
FIG. 5 is a control block diagram of the printer of the first embodiment of the present invention.

FIG. 5 is a control block diagram of the printer 10 of the first embodiment of the present invention.

In FIG. 5, the printer 10 includes a controller 50. The controller 50 includes a microprocessor, a read only memory (ROM), a random access memory (RAM), an input/output port, a timer, or the like, which are not illustrated. The controller 50 receives print data and control commands from a personal computer (PC) (not illustrated) serving as a host device and controls a sequence of operations of the printer 10 to form and print an image on a medium 18 (see FIG. 1).

The controller 50 is connected to charging roller power source controllers 52, the LED head controllers 53, developing roller power source controllers 54, supply roller power source controllers 55, transfer roller power source controllers 56, and a fixing controller 66. The charging roller power source controllers 52 are connected to charging roller voltage power sources 71. The LED head controllers 53 are connected to the LED heads 23. The developing roller power source controllers 54 are connected to developing roller voltage power sources 72. The supply roller power source controllers 55 are connected to supply roller voltage power sources 73. The transfer roller power source controllers 56 are connected to transfer roller voltage power sources 74. The fixing controller 66 is connected to the fixing device 17. The charging roller voltage power sources 71 are connected to the charging rollers 102. The developing roller voltage power sources 72 are connected to the developing rollers 104. The supply roller voltage power sources 73 are connected to the supply rollers 105. The transfer roller voltage power sources 74 are connected to the transfer rollers 30.

The charging roller power source controllers 52 apply charging voltages (direct-current voltages) to the charging rollers 102 in accordance with commands from the controller 50 to uniformly charge the surfaces of the photosensitive drums 101. The charging roller power source controllers 52 are provided to the respective image forming units 12K, 12Y, 12M, and 12C.

The LED head controllers 53 cause the LED heads 23 to emit light according to image data in accordance with commands from the controller 50 to illuminate the surfaces of the photosensitive drums 101 with the light to form electrostatic latent images as latent images. The LED head controllers 53 are provided to the respective LED heads 23K, 23Y, 23M, and 23C.

The developing roller power source controllers 54 apply developing voltages (direct-current voltages) to the developing rollers 104 in accordance with commands from the controller 50 to develop the electrostatic latent images on the photosensitive drums 101. The developing roller power source controllers 54 are provided to the respective image forming units 12K, 12Y, 12M, and 12C.

The supply roller power source controllers 55 apply supply voltages (direct-current voltages) to the supply rollers 105 in accordance with commands from the controller 50 to supply toner 140 to the developing rollers 104. The supply roller power source controllers 55 are provided to the respective image forming units 12K, 12Y, 12M, and 12C.

The transfer roller power source controllers 56 apply transfer voltages (direct-current voltages) to the transfer rollers 30 in accordance with commands from the controller 50 to transfer toner images on the photosensitive drums 101 onto a medium 18. The transfer roller power source controllers 56 are provided to the respective transfer rollers 30K, 30Y, 30M, and 30C.

The fixing controller 66 on/off controls the plate heater 1002 (see FIG. 4) on the basis of a temperature detected by a thermistor (not illustrated) serving as a surface temperature detector to maintain a fixing temperature at a constant temperature, in the fixing device 17.

The charging roller voltage power sources 71 generate the charging voltages applied to the charging rollers 102 under control of the charging roller power source controllers 52. The charging roller voltage power sources 71 are provided to the respective image forming units 12K, 12Y, 12M, and 12C.

The developing roller voltage power sources 72 generate the developing voltages applied to the developing rollers 104 under control of the developing roller power source controllers 54. The developing roller voltage power sources 72 are provided to the respective image forming units 12K, 12Y, 12M, and 12C.

The supply roller voltage power sources 73 generate the supply voltages applied to the supply rollers 105 under control of the supply roller power source controllers 55. The supply roller voltage power sources 73 are provided to the respective image forming units 12K, 12Y, 12M, and 12C.

The transfer roller voltage power sources 74 generate the transfer voltages applied to the transfer rollers 30 under control of the transfer roller power source controllers 56. The transfer roller voltage power sources 74 are provided to the respective transfer rollers 30K, 30Y, 30M, and 30C.

Further, the controller 50 is connected to ID motors 57, a sheet feed motor 58, a conveyance motor 59, the belt drive motor 60, the fixing motor 61, a discharge motor 62, a reconveyance motor 63, and a switching mechanism 64.

The ID motors 57 rotate the photosensitive drums 101. The rotation of the photosensitive drums 101 is transmitted to the developing rollers 104 and supply rollers 105 through power transmission systems. The charging rollers 102 and transfer rollers 30 are rotated in accordance with the rotation of the photosensitive drums 101. The ID motors 57 are provided to the respective image forming units 12K, 12Y, 12M, and 12C.

The sheet feed motor 58 rotates the pickup roller 19*a* and feeder roller 19*b* to feed a medium 18 from the sheet feed cassette 11.

The conveyance motor 59 rotates the conveying rollers 19*c*, 19*d*, 19*e*, and 19*f* to convey the medium 18.

The belt drive motor 60 rotates the drive roller 28 to move the transfer belt 27.

The fixing motor 61 rotates the fixing belt 1001 and pressure roller 37 of the fixing device 17 and conveys a medium 18 between the fixing belt 1001 and the pressure roller 37.

The discharge motor 62 rotates the discharge rollers 19*g*, 19*h*, 19*i*, and 19*j* to discharge a medium 18 to the outside of the printer 10.

The reconveyance motor 63 rotates the conveying rollers 19*k*, 191, 19*m*, 19*n*, 19*o*, 19*p*, 19*q*, 19*r*, 19*s*, 19*t*, 19*u*, 19*v*, 19*w*, and 19*x* to reconvey a medium 18 in duplex printing.

The switching mechanism (or actuator) 64 drives the switching guides 20 and 21 to switch the conveying path of the medium 18.

Next, the operation of the printer 10 will be described.

When the printer 10 receives a print command from the personal computer, the pickup roller 19*a* and feeder roller 19*b* are rotated by the sheet feed motor 58 to feed a medium 18 from the sheet feed cassette 11. Then, the conveying rollers 19*c*, 19*d*, 19*e*, and 19*f* are rotated by the conveyance motor 59 to feed the medium 18 to the image forming portion 22.

For each color, in the image forming unit 12, the ID motor 57 is driven to rotate the photosensitive drum 101 in the direction of arrow R. This rotates the charging roller 102, developing roller 104, supply roller 105, and transfer roller 30.

The charging roller 102 is applied with the charging voltage (e.g., −1050 V) by the charging roller voltage power sources 71, so that the surface of the photosensitive drum 101 in contact with the charging roller 102 is uniformly charged (to a voltage of, for example, −550 V). Although in this embodiment, the photosensitive drum 101 having a drum shape is used as an electrostatic latent image carrier, a belt-shaped electrostatic latent image carrier may be used.

Then, the LED head 23 illuminates the surface of the photosensitive drum 101 in accordance with image information included in the print command. Specifically, the LED head 23K illuminates the surface of the photosensitive drum 101K of the image forming unit 12K, the LED head 23Y illuminates the surface of the photosensitive drum 101Y of the image forming unit 12Y, the LED head 23M illuminates the surface of the photosensitive drum 101M of the image forming unit 12M, and the LED head 23C illuminates the surface of the photosensitive drum 101C of the image forming unit 12C. The potential of the illuminated (or exposed) part of the photosensitive drum 101 decreases to about −100 V, so that an electrostatic latent image is formed.

The supply roller 105 is applied with the supply voltage (e.g., −350 V) from the supply roller voltage power sources 73. The supply roller 105 is a sponge roller extending in a longitudinal direction, and includes a metal core and a silicone foam rubber layer formed around the metal core and having open cells having cell diameters of 300 to 500 μm.

The supply roller 105 carries, on its surface and in its cells, toner 140 stored in the toner holding portion 103 (see FIG. 3), and is rotated in the direction of arrow F to supply the toner 140 to the developing roller 104.

The developing roller power source controller 54 applies the developing voltage (e.g., −250 V) to the developing roller 104. The developing roller 104 carries the toner 140 due to the potential difference and sliding between the developing roller 104 and the supply roller 105, and is rotated in the direction of arrow E. As the developing roller 104 rotates, the developing blade 107 uniforms the thickness of the toner 140 on the surface of the developing roller 104 to form a toner layer on the developing roller 104. The toner 140 carried on the developing roller 104 is frictionally charged to a negative polarity due to sliding between the developing roller 104 and the supply roller 105 and friction with the developing blade 107. Specifically, the toner 140 is charged to about −50 V.

The toner 140 described here is, for example, a negatively charged toner for single-component development. Thus, the toner 140 has a negative charge polarity. Single-component development is a method in which toner is provided with an appropriate charge amount without using carrier (magnetic particles) for providing the toner with charge. On the other hand, two-component development is a method in which carrier and toner are mixed together, and the toner is provided with an appropriate charge amount by taking advantage of friction between the carrier and the toner.

Although in this embodiment, the toner 140 is used in single-component development without using carrier as a developer, the toner 140 can be used as toner used along with carrier in two-component development, i.e., toner contained in developer in two-component development.

The manufacturing method of the toner is not limited to any particular method. Specifically, the manufacturing method of the toner may be a pulverization method, a polymerization method, or other methods. Also, two or more of these methods may be used together. Examples of the polymerization method include an emulsion polymerization aggregation method, a dissolution suspension method, and the like.

The electrostatic latent image formed on the photosensitive drum 101 by the LED head 23 is reversely developed with the toner 140 carried on the surface of the developing roller 104. Specifically, an electric field is generated by the potential difference between the photosensitive drum 101 with the electrostatic latent image formed thereon and the developing roller 104, and toner 140 on the surface of the developing roller 104 adheres to the electrostatic latent image on the photosensitive drum 101 due to the electrostatic force. Thereby, a toner image is formed on the surface of the photosensitive drum 101.

In accordance with the timing when the medium 18 reaches the position where the photosensitive drum 101 and transfer roller 30 are pressed against each other, the transfer roller voltage power source 74 applies the transfer voltage (e.g., +3000 V) to the transfer roller 30 rotated in the direction of arrow T. The transfer voltage transfers the toner image formed on the surface of the photosensitive drum 101 onto the medium 18.

The medium 18 with the toner images of the respective colors transferred thereon is conveyed in the direction of arrow G and fed to the fixing device 17.

The medium 18 with the toner image transferred thereon is fed to the nip portion N between the fixing belt 1001 and the pressure roller 37, which are rotated in the directions of arrows H and I by the fixing motor 61. The fixing belt 1001 is maintained at a predetermined surface temperature by the fixing controller 66, the pressure roller 37 is also heated by the heat of the fixing belt 1001, and the toner 140 of the toner image formed on the medium 18 is fused. The fused toner 140 is further pressed in the nip portion N, so that the toner image is fixed to the medium 18.

Then, in accordance with the print command, the medium 18 with the toner image fixed thereto is conveyed simply to the medium discharge unit 14 in simplex printing and conveyed to the reconveying unit 15 in duplex printing.

In simplex printing, the medium 18 discharged from the fixing device 17 is conveyed to the medium discharge unit 14 by the switching guide 20, conveyed in the direction of arrow J, and discharged to the outside of the printer 10. The discharged medium 18 is placed on the stacking portion 24.

In duplex printing, the medium 18 discharged from the fixing device 17 is conveyed to the reconveying unit 15 by the switching guides 20 and 21, conveyed on the return path in the direction of arrow M by the conveying rollers 19*m*, 19*n*, 19*o*, 19*p*, 19*q*, 19*r*, 19*s*, 19*t*, 19*u*, and 19*v*, which are rotated by the conveyance motor 59 and reconveyance motor 63, and conveyed to the medium feeding unit 13. Then, after the printing operation is performed again on the back side of the medium 18, the medium 18 is conveyed to the medium discharge unit 14, conveyed in the direction of arrow J, and discharged to the outside of the printer 10.

When negatively charged toners are used as the toners 140, the charging potentials and development potentials are negative, and the transfer rollers 30 are applied with positive voltages. However, when positively charged toners are used as the toners 140, the charging potentials and development potentials are positive, and the transfer rollers 30 are applied with negative voltages.

Next, examples of the cyan toner 140C produced by different production methods using pulverization will be described.

Example 1

First, 100 parts by weight of binder resin was added with 0.5 parts by weight of BONTRON E-84 (registered trademark) (manufactured by Orient Chemical Industries Co., Ltd.) serving as a charge control agent, 4.0 parts by weight of carnauba wax (Carnauba Wax No. 1 powder, manufactured by S. Kato & CO.) serving as a release agent, 5.6 parts by weight of Pigment Blue 15:3 (PB 15:3), and 0.5 parts by weight of Pigment Green 7 (PG 7). The Pigment Blue 15:3 and the Pigment Green 7 were colorants of the cyan toner. The mixing ratio of the Pigment Blue 15:3 and the Pigment Green 7 was about 10:1. Then, the resultant was mixed using a Henschel mixer, and then melted and kneaded with a twin screw extruder and cooled. After the cooling, the kneaded product was roughly pulverized with a cutter mill, and then pulverized with an impact type mill. Then, the pulverized product was classified with a pneumatic classifier, so that toner base particles having a predetermined particle diameter were obtained.

The binder resin is a material for binding colorant and the like, and so-called binder. The binder resin may include one or more types of polymers, such as polyester resin, styrene-acrylic resin, epoxy resin, styrene-butadiene resin, and polyurethane resin. The crystalline state of the polymer is not limited, and the polymer may be crystalline or amorphous. To smooth the image surface and increase the image density, the binder resin preferably includes polyester resin. In Example 1, the binder resin was polyester resin.

Then, in an external addition process, 3.0 parts by weight of hydrophobic silica (R972, manufactured by Nippon Aerosil Co., Ltd., having an average particle diameter of 16 nm) was added to 1 kg (100 parts by weight) of the toner base particles, and stirred for 3 minutes with a Henschel mixer, so that cyan toner C-1 was produced.

Example 2

Cyan toner C-2 was produced in the same manner as in Example 1 except that the amount of the Pigment Blue 15:3 was changed to 5.9 parts by weight and the amount of the Pigment Green 7 was changed to 0.6 parts by weight.

Example 3

Cyan toner C-3 was produced in the same manner as in Example 1 except that the amount of the Pigment Blue 15:3 was changed to 6.3 parts by weight and the amount of the Pigment Green 7 was changed to 0.6 parts by weight.

Example 4

Cyan toner C-4 was produced in the same manner as in Example 1 except that the amount of the Pigment Blue 15:3 was changed to 3.7 parts by weight and the amount of the Pigment Green 7 was changed to 0.4 parts by weight.

Example 5

Cyan toner C-5 was produced in the same manner as in Example 1 except that the amount of the Pigment Blue 15:3 was changed to 8.7 parts by weight and the amount of the Pigment Green 7 was changed to 0.9 parts by weight.

Example 6

Cyan toner C-6 was produced in the same manner as in Example 1 except that the amount of the Pigment Blue 15:3 was changed to 8.7 parts by weight and the amount of the Pigment Green 7 was changed to 1.1 parts by weight.

Example 7

Cyan toner C-7 was produced in the same manner as in Example 1 except that the amount of the Pigment Blue 15:3 was changed to 8.7 parts by weight and the amount of the Pigment Green 7 was changed to 2.4 parts by weight.

Example 8

Cyan toner C-8 was produced in the same manner as in Example 1 except that the amount of the Pigment Blue 15:3 was changed to 3.5 parts by weight and the amount of the Pigment Green 7 was changed to 0.4 parts by weight.

Example 9

Cyan toner C-9 was produced in the same manner as in Example 1 except that the amount of the Pigment Blue 15:3 was changed to 3.1 parts by weight and the amount of the Pigment Green 7 was changed to 0.3 parts by weight.

For each of cyan toners C-1 to C-9 of Examples 1 to 9 produced as above, a powder color, a volume median diameter D50, a melting temperature T1/2, and glass transition temperatures Tg were measured by the following methods.

The powder color is the color of the cyan toner in a powder state, and is represented by a lightness L*, a hue a*, and a hue b*, i.e., coordinates (L*, a*, b*), in an L*a*b* color system.

In the L*a*b* color system, L* is a value representing lightness in the L* axis direction, a* is a value representing hue in the a* axis direction, i.e., red-green direction, and b* is a value representing hue in the b* axis direction, i.e., yellow-blue direction.

The powder color was measured using a spectrophotometer (SE-2000, manufactured by Nippon Denshoku Industries Co., Ltd.) under the conditions of a C light source, a visual field of 2 degrees, and a reflection method. Specifically, the powder color was measured by putting 3.0 g of the cyan toner into a cylindrical measurement cell for powder (having a thickness of 2 mm and a diameter of 30 mm), which is an accessory of the spectrophotometer, vertically shaking the powder measurement cell once per second for 30 seconds with respect to the gravity direction to condense the cyan toner, and then measuring L*, a*, and b* of the cyan toner in the powder state.

The volume median diameter D50 was measured using a cell counter and analyzer (Coulter Multisizer III, manufactured by Beckman Coulter, Inc.) under the measurement conditions that the aperture diameter was 100 μm, and the number of measured particles was 30000. In this specification, the volume median diameter D50 refers to the particle diameter at which the cumulative volume percentage is 50%.

The volume median diameter D50 was measured under the following measurement conditions.

Polyoxyethylene lauryl ether (EMULGEN 109P, manufactured by Kao Corporation) was dissolved in electrolyte (ISOTON II, manufactured by Beckman Coulter, Inc.), so that a dispersion liquid having a concentration of 5 wt % was prepared. Then, 10 mg of the cyan toner was added to 5 ml of the dispersion liquid and dispersed with an ultrasonic disperser for one minute. Then, the dispersion liquid was added with 25 ml of the electrolyte, and further dispersed with the ultrasonic disperser for one minute, so that a cyan toner dispersion liquid was prepared. Then, the prepared cyan toner dispersion liquid was added to 100 ml of the electrolyte, and the volume median diameter D50 was measured with the cell counter and analyzer.

The melting temperature T1/2 was measured using a flow tester (CFT-500D, manufactured by Shimadzu Corporation) as follows. Under the conditions of a load of 10 kg and a die hole diameter of 1 mm, 1 g of the cyan toner in the form of a pellet was heated from a start temperature of 50° C. at a temperature rising rate of 3° C./min. The amount of descent of the plunger of the flow tester was plotted with respect to the temperature, and the temperature at which half of the cyan toner was flowed out was determined as the melting temperature T1/2.

The glass transition temperatures Tg were measured using a differential scanning calorimeter (DSC6220, manufactured by Hitachi High-Tech Science Corporation) under the measurement conditions described below. In this case, the measurement was made after 0.01 to 0.02 g of the cyan toner was put in an aluminum pan and sealed with a dedicated jig.

An endothermic curve was measured by the differential scanning calorimeter as follows (with the following temperature program pattern).

In a first temperature increase, the cyan toner sealed in the aluminum pan was left at a temperature of 20° C. for 10 minutes, heated to 200° C. at a temperature increase rate of 10° C./min, left at 200° C. for 5 minutes, cooled to 0° C. at a temperature decrease rate of 90° C./min, and left at 0° C. for 5 minutes.

In a second temperature increase, the cyan toner was heated to 20° C. at a temperature increase rate of 60° C./min, left at 20° C. for 10 minutes, and heated to 200° C. at a temperature increase rate of 10° C./min.

The temperature at an intersection of an extension line of a base line of the endothermic curve below a highest endothermic peak temperature in the first temperature increase and a tangent line to the endothermic curve showing a maximum slope between a rising point of the peak and a top of the peak was determined as a first glass transition temperature Tg_1st. Also, the temperature at an intersection of an extension line of a base line of the endothermic curve below a highest endothermic peak temperature in the second temperature increase and a tangent line to the endothermic curve showing a maximum slope between a rising point of the peak and a top of the peak was determined as a second glass transition temperature Tg_2nd.

FIG. 11 shows the results of the measurements of the powder colors and physical properties of cyan toners C-1 to C-9 of Examples 1 to 9. It was found that as the amount (parts by weight) of the Pigment Blue 15:3 (PB 15:3) increases, the lightness represented by L* of the powder color greatly decreases.

For each of cyan toners C-1 to C-9, image densities and print colors were measured and evaluated as follows.

In this embodiment, a medium 18 to which a toner image has been fixed by the fixing device 17 is referred to as a "printed product". A print color is a color of a printed product and represented by L*, a*, and b* in the L*a*b* color system.

The image densities and print colors were measured using a color LED printer (C811, manufactured by Oki Data Corporation). The image densities were measured relative to the amount of the cyan toner deposited on (or adhering to) the medium 18, which will be referred to as the toner deposition amount. The toner deposition amount is represented by the weight per unit area (mg/cm$^2$) of a toner image transferred onto a medium 18 by the transfer unit 16. Cyan toners C-1 to C-9 were used as the cyan toner 140C, and black, yellow, and magenta toners in toner cartridges 120 mounted in the color LED printer were used as the black toner 140K, yellow toner 140K, and magenta toner 140M.

Here, the lightness L*, hue a*, and hue b* of the powder color of each of the yellow toner 140Y, magenta toner 140M, and black toner 140K of the color LED printer were as follows.

The powder color of the yellow toner 140Y was L*=88.47, a*=−7.76, b*=106.88.

The powder color of the magenta toner 140M was L*=39.68, a*=63.48, b*=5.95.

The powder color of the black toner 140K was L*=11.67, a*=0.34, b*=0.01.

In the measurements of the image densities and print colors, the speed at which the medium 18 passes through the nip portion N of the fixing device 17 was 200 mm/s; in the fixing device 17, the temperature of a center portion of the fixing belt 1001 in the longitudinal direction was 155±5° C., and the temperature of the pressure roller 37 was 135±5° C.

The media 18 used in the measurements of the image densities and print colors were Excellent White A4 (manufactured by Oki Data Corporation, having a ream weight of 70 kg, and having a basis weight of 80 g/m$^2$). The media 18 satisfied $$96.3 \le L^*(W) \le 96.8,$$

$$1.7 \le a^*(W) \le 2.0, \text{ and}$$

$$-5.6 \le b^*(W) \le -5.2$$

where L*(W), a*(W), and b*(W) were respectively the lightnesses L*, hues a*, and hues b* of the media 18 in the L*a*b* color system measured under measurement conditions described later.

The Bekk smoothnesses of the media 18 used in the measurements of the image densities and print colors were measured using a Bekk smoothness tester (DIGI-BEKK DB-2, manufactured by Toyo Seiki Seisaku-sho, Ltd.). The Bekk smoothnesses were measured under the conditions described in JIS P 8119. The measured Bekk smoothnesses satisfied $$78.0\ \text{s} \leq \text{Bekk smoothness} \leq 129.3\ \text{s}.$$

For each of cyan toners C-1 to C-9, image densities were measured and evaluated relative to the toner deposition amount according to the following method.

Figure 6:
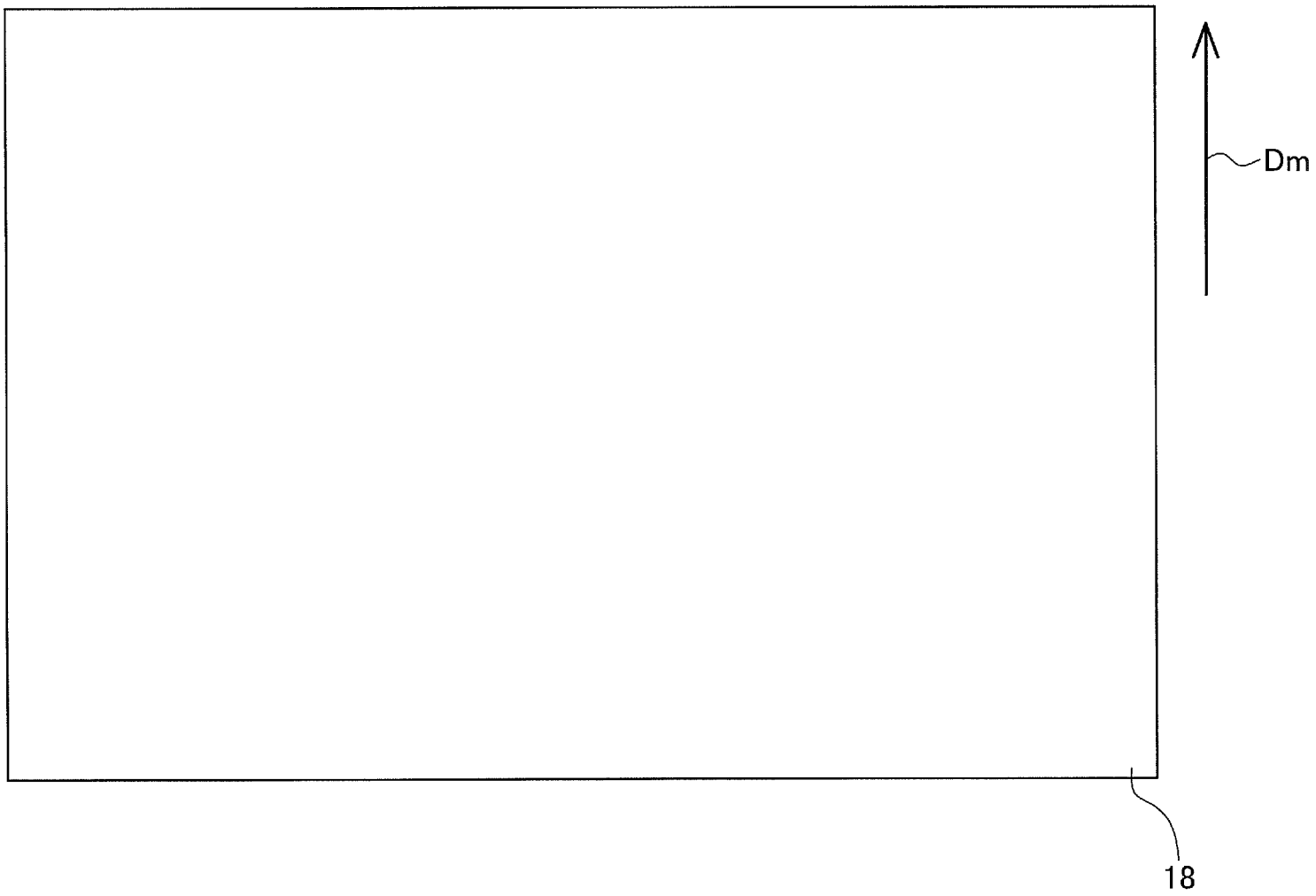
FIG. 6 is a plan view illustrating a medium that has been subjected to blank page printing in the first embodiment of the present invention.
Figure 7:
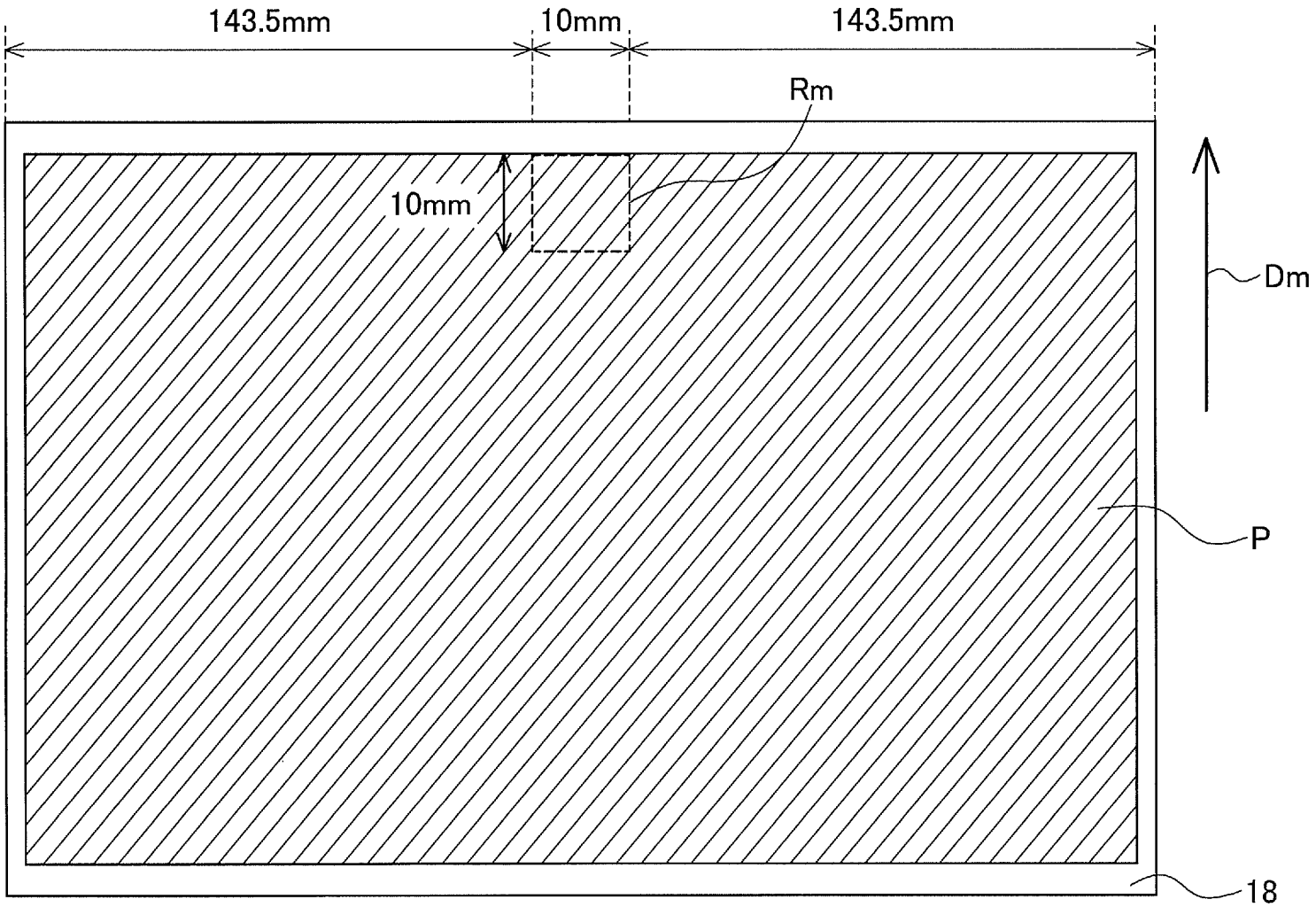
FIG. 7 is a plan view illustrating a cyan density measurement print pattern in the first embodiment of the present invention.

FIG. 6 is a plan view illustrating a medium 18 that has been subjected to blank page printing in the first embodiment of the present invention. FIG. 7 is a plan view illustrating a cyan density measurement print pattern P in the first embodiment of the present invention. In FIGS. 6 and 7, arrow Dm indicates a direction in which the medium 18 is conveyed.

The cyan density measurement print pattern P is formed with the cyan toner at a print duty of 100%.

Image densities of printed products were measured using a densitometer (X-Rite 528, manufactured by X-Rite Inc.). Measurement conditions of the densitometer were set as follows. The measurement mode was set to "density measurement mode". The status was set to "status I". The white reference was set to "absolute white reference". The polarization filter setting was set to "no polarization filter". The image densities were measured after calibration with a white calibration plate.

"Status I" is a setting of wavelength regions for measurement, and specified in ISO 5-3 "Photography and graphic technology—Density measurements—Part 3: Spectral conditions".

In the measurements of the image densities of the printed products, a black paper medium (or a black paper sheet) was used as a mat placed under the printed products. Specifically, the black paper sheet was a sheet of "colored high-quality paper black" (manufactured by Hokuetsu Corp.) that satisfied $$25.1 \leq L^*(B) \leq 25.9,$$

$$0.2 \leq a^*(B) \leq 0.3, \text{ and}$$

$$0.5 \leq b^*(B) \leq 0.7$$

where L*(B), a*(B), and b*(B) were respectively the lightness L*, hue a*, and hue b* of the sheet in the L*a*b* color system.

Based on the above settings, the densitometer provides, as image densities, four values: a V value (visual value), a Y value (yellow value), an M value (magenta value), and a C value (cyan value), which are represented as optical densities (ODs) measured under the above measurement conditions.

In the measurements of the image densities and print colors, the C value was used as the image density of the cyan toner, the M value was used as the image density of the magenta toner, and the Y value was used as the image density of the yellow toner.

Based on the above, the measurements of the image densities relative to the toner deposition amount were performed according to the following steps:

(1) leaving the printer 10 with the image forming units 12 mounted therein and media 18 in an environment at a temperature of 22° C. and a relative humidity of 55% for 24 hours;

(2) performing blank page printing as illustrated in FIG. 6 on one of the media 18 every 30 seconds for 10 minutes to warm up the fixing device 17, heating the fixing belt 1001 to 155±5° C. and the pressure roller 37 to 135±5° C.;

(3) printing the cyan density measurement print pattern P as illustrated in FIG. 7 on one of the media 18 to obtain a printed product;

(4) starting printing again under the same printing conditions as the printing in step (3) to form the cyan density measurement print pattern P on one of the media 18, and stopping the printing before a measurement region Rm illustrated in FIG. 7 reaches the fixing device 17;

(5) measuring the image density of the measurement region Rm of the printed product obtained in step (3);

(6) measuring the toner deposition amount of the measurement region Rm of the cyan density measurement print pattern P formed in step (4);

(7) appropriately changing the developing voltage applied to the developing roller 104 of the image forming unit 12C with the toner cartridge 120C storing the cyan toner mounted thereto, within the range of −100 to −300 V; and (8) repeating the above steps (1) to (7) 10 times.

The toner deposition amount of the cyan toner was expressed in weight per unit area (mg/cm$^2$). In step (6), the toner deposition amount of the cyan toner was measured or calculated according to the following steps:

attaching a piece of double-sided tape to a planar portion (having an area of 1 cm$^2$) of a metal jig;

applying a direct-current voltage of +300 V to the jig by means of an external power source;

pressing once the jig to the measurement region Rm of the cyan density measurement print pattern P formed in step (4) to take cyan toner on the medium 18;

measuring the weight of the jig with the cyan toner adhering thereto by means of an electric balance (CPA225D, manufactured by Sartorius); and subtracting, from the weight of the jig measured after taking the cyan toner, the weight of the jig before taking the cyan toner, thereby calculating the toner deposition amount.

On the basis of the image densities measured in step (5) and the toner deposition amounts measured in step (6), a linear function y=ax+b was calculated using a least-square method. In this linear approximation, x was the toner deposition amount, and y was the image density. Then, by using the linear function, the image density at a toner deposition amount of 0.30 mg/cm$^2$ and the image density at a toner deposition amount of 0.35 mg/cm$^2$ were calculated. The values of 0.35 mg/cm$^2$ and 0.30 mg/cm$^2$ were set as indexes for reducing the toner deposition amount.

Then, a coefficient of determination $R^2$ for the linear approximation was calculated. A value $R^2$ closer to 1 indicates that the image density is more proportional to the toner deposition amount, i.e., the ratio of the change in the image density to a change in the toner deposition amount is more constant.

FIG. 12 shows, for each of cyan toners C-1 to C-9, the results of the measurements and evaluations of the image densities relative to the toner deposition amount. It can be seen that the higher the value of an image density, the higher the density of the printed product, and the better the result of evaluation of the image density relative to the toner deposition amount. Each of the image densities was evaluated as "excellent" when it was greater than or equal to 1.50, "good" when it was greater than or equal to 1.40 and less than 1.50, and "poor" when it was less than 1.40. That is, each image density was rated as "excellent" if image density≥1.50, "good" if 1.40≤image density<1.50, and "poor" if 1.40>image density.

In this embodiment, for cyan toners C-1 to C-7, the image density at a toner deposition amount of 0.35 mg/cm$^2$ was greater than or equal to 1.50. For cyan toners C-1 to C-3 and C-5 to C-7, the image density at a toner deposition amount of 0.30 mg/cm$^2$ was greater than or equal to 1.50. On the other hand, for cyan toners C-8 and C-9, the image density at a toner deposition amount of 0.35 mg/cm$^2$ was less than 1.50. For cyan toners containing much cyan pigment, the image densities at toner deposition amounts of 0.35 mg/cm$^2$ and 0.30 mg/cm$^2$ were high. This is considered to be because the large amounts of cyan pigment contained in the cyan toners decreased the lightnesses L* of the powder colors and increased the image densities.

Further, for each of cyan toners C-1 to C-9, the toner deposition amount at an image density of 1.50 was calculated from the linear function. The calculated toner deposition amounts were 0.30 mg/cm$^2$ for cyan toner C-1, 0.30 mg/cm$^2$ for cyan toner C-2, 0.26 mg/cm$^2$ for cyan toner C-3, 0.35 mg/cm$^2$ for cyan toner C-4, 0.29 mg/cm$^2$ for cyan toner C-5, 0.29 mg/cm$^2$ for cyan toner C-6, 0.29 mg/cm$^2$ for cyan toner C-7, 0.39 mg/cm$^2$ for cyan toner C-8, and 0.40 mg/cm$^2$ for cyan toner C-9.

For each of cyan toners C-1 to C-9, print colors of a printed product were measured and evaluated as follows.

First, a method of evaluating the print colors of the printed product will be described.

Figure 8:
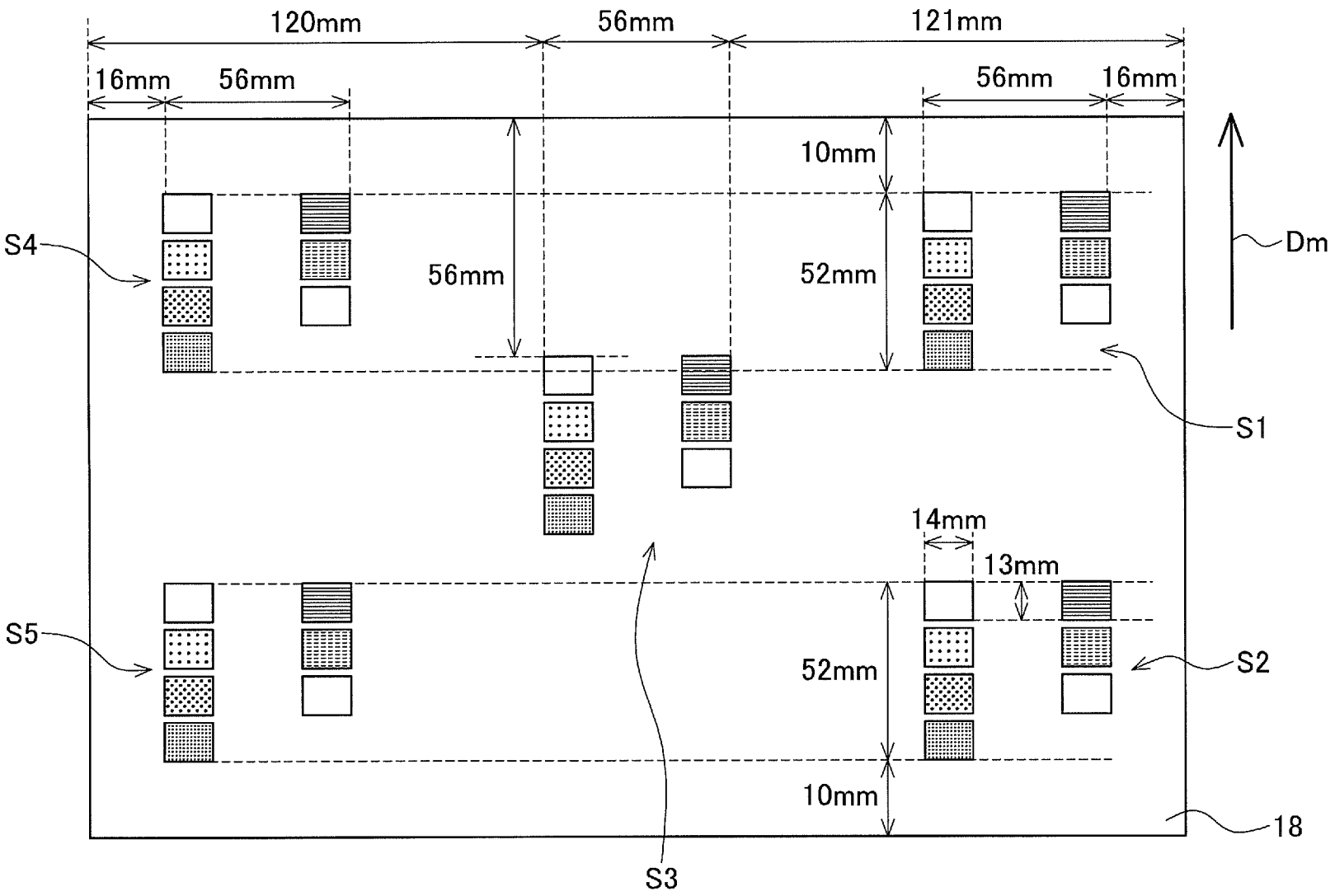
FIG. 8 is a plan view indicating the positions of toner patches of a print color measurement print pattern on a medium in the first embodiment of the present invention.
Figure 9:
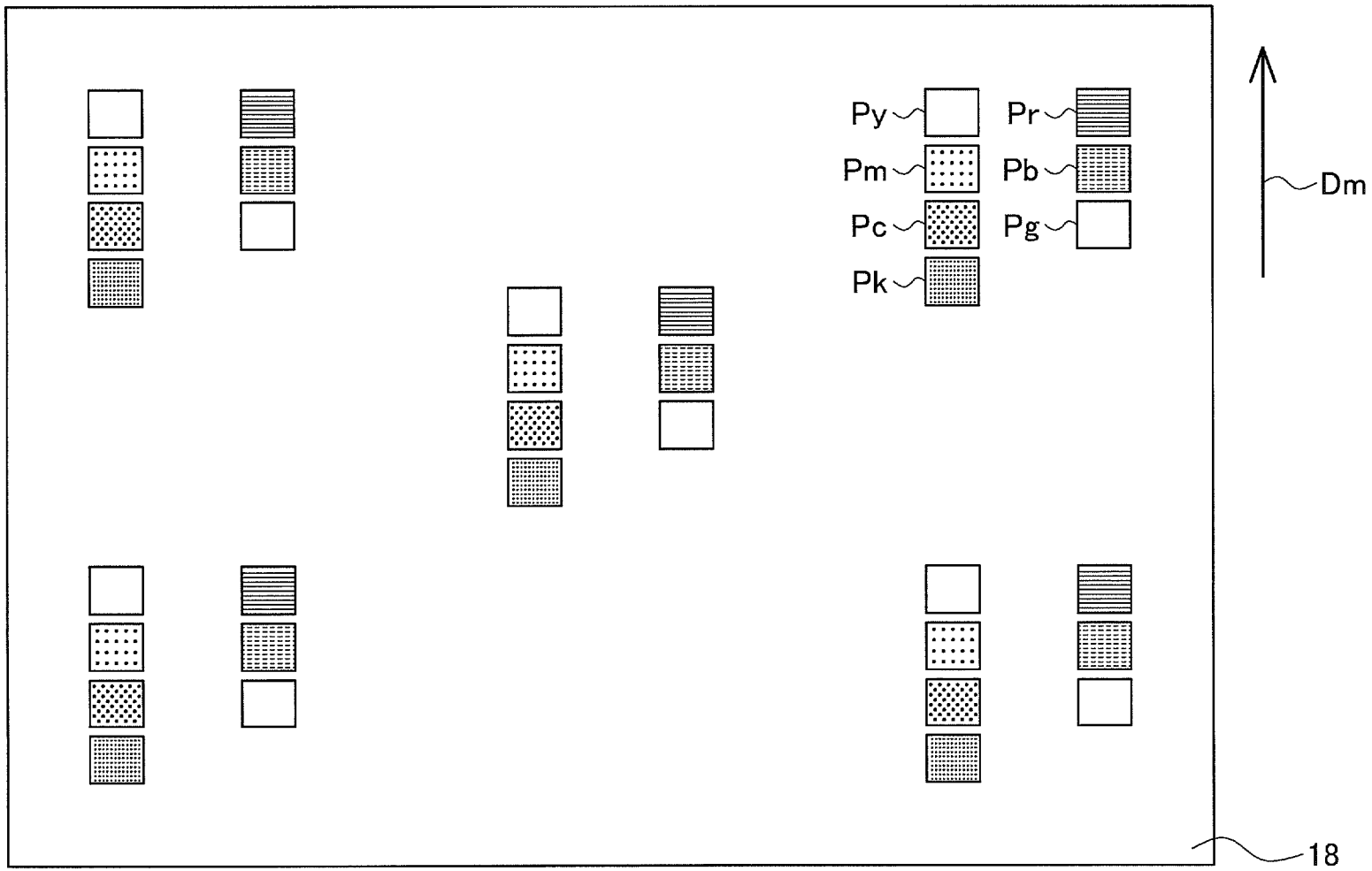
FIG. 9 is a plan view for explaining the types of the toner patches of the print color measurement print pattern in the first embodiment of the present invention.

FIG. 8 is a plan view indicating the positions of toner patches of a print color measurement print pattern on a medium 18 in the first embodiment of the present invention. FIG. 9 is a plan view for explaining the types of the toner patches of the print color measurement print pattern in the first embodiment of the present invention. In FIGS. 8 and 9, arrow Dm indicates a direction in which the medium 18 is conveyed.

Conditions of the densitometer X-Rite 528 for measuring print colors were set as follows.

The measurement mode was set to "measurement mode with the L*a*b* color system". The status was set to "status I". The observation light source (illuminant) was set to "D50" (a light source having a color temperature of about 5000 K). The viewing angle (observation visual field) was set to "2°". The white reference was set to "absolute white reference". The polarization filter setting was set to "no polarization filter". The print colors were measured after calibration with a white calibration plate.

The print color measurement print pattern includes color measurement patch sets S1 to S5 formed at five positions on a medium 18. Each color measurement patch set includes a black patch Pk with a density of 100%, a yellow patch Py with a density of 100%, a magenta patch Pm with a density of 100%, a cyan patch Pc with a density of 100%, a red patch Pr with a density of 200%, a green patch Pg with a density of 200%, and a blue patch Pb with a density of 200%.

The 100%-density black patch Pk, 100%-density yellow patch Py, 100%-density magenta patch Pm, and 100%-density cyan patch Pc are formed at a print duty of 100% using only black toner, yellow toner, magenta toner, and cyan toner, respectively. The 200%-density red patch Pr is formed at a print duty of 200% by superimposing a yellow toner image formed at a print duty of 100% and a magenta toner image formed at a print duty of 100%. The 200%-density green patch Pg is formed at a print duty of 200% by superimposing a yellow toner image formed at a print duty of 100% and a cyan toner image formed at a print duty of 100%. The 200%-density blue patch Pb is formed at a print duty of 200% by superimposing a magenta toner image formed at a print duty of 100% and a cyan toner image formed at a print duty of 100%.

The print duty refers to the ratio of the area of an image actually formed on a medium 18 to the area of the entire image formable region of the medium 18. Specifically, the print duty refers to the percentage of the number of dots actually formed in a region having a predetermined area of a medium 18 to the number of dots that can be formed in the entire region. That is, the print duty indicates a print percentage. For example, the print duty is calculated by the following formula:

$$D=(dc/dca)\times 100\%$$

where D is the print duty, dc is the number of dots printed on a medium 18, and dca is the number of dots that would be printed on the medium 18 if printing were performed on the medium 18 through an overall exposure. The print duty can be calculated by other formulae.

In the measurements of the print colors of the printed product, a stack of five sheets of Excellent White A4, described above, was used as a mat placed under the printed product.

The print colors of the printed product were measured and evaluated according to the following steps:

(1) leaving the printer 10 and media 18 in an environment at a temperature of 22° C. and a relative humidity of 55% for 24 hours;

(2) performing blank page printing as illustrated in FIG. 6 on one of the media 18 every 30 seconds for 10 minutes to warm up the fixing device 17, heating the fixing belt 1001 to 155±5° C. and the pressure roller 37 to 135±5° C.;

(3) adjusting the developing voltages of the developing rollers 104 of the image forming units 12 so that when the print color measurement print pattern as illustrated in FIGS. 8 and 9 is printed by forming the 100%-density yellow patches Py, 100%-density magenta patches Pm, and 100%-density cyan patches Pc at the five positions on a medium 18, the average of the image densities of the five yellow patches Py is 1.50, the average of the image densities of the five magenta patches Pm is 1.50, and the average of the image densities of the five cyan patches Pc is 1.50;

(4) printing the print color measurement print pattern as illustrated in FIGS. 8 and 9 on one of the media 18 to obtain a printed product;

(5) measuring the lightness L*, hue a*, and hue b* of the print color of each of the five 100%-density cyan patches Pc (each of which is a cyan toner image formed at a print duty of 100%), the five 200%-density green patches Pg (each of which is the combination of a yellow toner image formed at a print duty of 100% and a cyan toner image formed at a print duty of 100%), and the five 200%-density blue patches Pb (each of which is the combination of a magenta toner image formed at a print duty of 100% and a cyan toner image formed at a print duty of 100%) of the printed product obtained in step (4), and calculating, for each of cyan, green and blue, the average of the lightnesses L*, the average of the hues a*, and the average of the hues b*; and (6) calculating, for each of cyan, green and blue, a color difference (maximum color difference) ΔE between an average print color having the average of the lightnesses L*, the average of the hues a*, and the average of the hues b* calculated in step (5) and a reference color.

When the developing voltages of the developing rollers 104 were adjusted in step (3) so that the averages of the image densities were 1.50, the toner deposition amount of the cyan toner was as shown in FIG. 12, the toner deposition amount of the yellow toner 140Y stored in the toner cartridge mounted in the color LED printer (C811, manufactured by Oki Data Corporation) was 0.38 mg/cm$^2$, and the toner deposition amount of the magenta toner 140M stored in the toner cartridge mounted in the printer was 0.46 mg/cm$^2$. Here, the toner deposition amounts of the yellow toner 140Y and magenta toner 140M were calculated in the same manner as the toner deposition amounts of cyan toners C-1 to C-9.

In step (6), for each of cyan, green, and blue, a lightness L*, a hue a*, and a hue b* of a print sample awarded Japan Color Certification measured under the above-described print color measurement conditions were taken as the lightness L*, hue a*, and hue b* of the reference color. For each of cyan, green, and blue, on the basis of the average print color and the reference color, the color difference ΔE was calculated by the following equation:

$$\Delta E=((\Delta a^*)^2+(\Delta b^*)^2+(\Delta L^*)^2)^{1/2}$$

where Δa* is the difference between the hues a* of the average print color and the reference color, Δb* is the difference between the hues b* of the average print color and the reference color, and ΔL* is the difference between the lightnesses L* of the average print color and the reference color. The smaller the color difference ΔE, the better the color reproducibility.

The lightnesses L*, hues a*, and hues b* of the reference colors were specifically as follows:

L*=22.0, a*=20.0, b*=−47.7 for blue,

L*=53.4, a*=−36.3, b*=−51.5 for cyan, and

L*=47.7, a*=−70.6, b*=22.4 for green.

For each color, when the color difference ΔE was less than or equal to 16.0, since the print color was visually excellent, the print color was evaluated as "excellent"; when the color difference ΔE was greater than 16.0 and less than or equal to 20.0, since it was determined by visual evaluation that there was no practical problem, the print color was evaluated as "good"; when the color difference ΔE was greater than 20.0, since it was determined by visual evaluation that there was a practical problem, the print color was evaluated as "poor". That is, the print color was rated as "excellent" if ΔE≤16.0, "good" if 16.0<ΔE≤20.0, and "poor" if 20.0<ΔE.

FIG. 13 shows, for each of cyan toners C-1 to C-9 and for each of blue (B), cyan (C), and green (G), the lightness L*, hue a*, and hue b* of the average print color calculated in step (5), the color difference ΔE between the average print color and the reference color calculated in step (6), and the result of the evaluation of the print color. As can be seen from FIG. 13, for cyan toners C-1 to C-4 and C-8, since the color differences ΔE were less than or equal to 16.0, the evaluation results of blue (B), cyan (C), and green (G) were all "excellent". For cyan toner C-5, since the color difference ΔE of cyan (C) was greater than 16.0 and less than or equal to 20.0, the evaluation result of cyan (C) was "good". For cyan toners C-6 and C-7, since the color difference ΔE of green (G) was greater than 16.0 and less than or equal to 20.0, the evaluation result of green (G) was "good".

FIG. 14 shows, for each of cyan toners C-1 to C-9, a comprehensive evaluation based on the evaluation results of the image densities (in FIG. 12) and the evaluation results of the print colors (in FIG. 13). For each of cyan toners C-1 to C-9, the cyan toner was comprehensively evaluated as "A" when all the evaluation results of FIGS. 12 and 13 were "excellent", "B" when all the evaluation results were not "poor" but at least one of the evaluation results was "good", and "C" when at least one of the evaluation results was "poor".

FIG. 14 shows that for cyan toners C-1 to C-3, the evaluation results of the image densities were "excellent" and the evaluation results of the print colors were also "excellent", and thus the comprehensive evaluation was "A".

For cyan toners C-1 to C-3, the toner deposition amount at an image density of 1.50 was less than or equal to 0.30 mg/cm$^2$.

Thus, when the lightness L*, hue a*, and hue b* of a cyan toner in a powder state satisfy $$30.04 \le L^* \le 33.68,$$

$$-1.75 \le a^* \le 0.71, \text{ and}$$

$$-47.47 \le b^* \le -45.08,$$

the cyan toner provides sufficient image density at a toner deposition amount of 0.30 mg/cm$^2$ or less, and the color difference between the print color of an image printed by superimposing the cyan toner and a toner of another color and a corresponding reference color is visually excellent.

For cyan toners C-4 to C-7, all the evaluation results were not "poor" but at least one of the evaluation results was "good", and thus the comprehensive evaluation was "B".

For cyan toners C-4 to C-7, the toner deposition amount at an image density of 1.50 was less than or equal to 0.35 mg/cm$^2$.

Thus, when the lightness L*, hue a*, and hue b* of a cyan toner in a powder state satisfy $$26.94 \le L^* \le 34.84,$$

$$-5.13 \le a^* \le 3.83, \text{ and}$$

$$-47.47 \le b^* \le -36.78,$$

the cyan toner provides sufficient image density at a toner deposition amount of 0.35 mg/cm$^2$ or less, and the color difference between the print color of an image printed by superimposing the cyan toner and a toner of another color and a corresponding reference color is visually good or excellent.

On the other hand, for cyan toners C-8 and C-9, the evaluation results of the print colors were all "excellent" but at least one of the evaluation results of the image densities was "poor", and thus the comprehensive evaluation was "C". For cyan toners C-8 and C-9, the toner deposition amount at an image density of 1.50 was greater than 0.35 mg/cm$^2$. Thus, for cyan toners C-8 and C-9, the color differences from the reference colors were visually excellent, but the toner deposition amount was large.

In this embodiment, the toner cartridge 120C stores a cyan toner (e.g., cyan toners C-1 to C-7) having, in a powder state, a lightness L*, a hue a*, and a hue b* satisfying $$26.94 \le L^* \le 34.84,$$

$$-5.13 \le a^* \le 3.83, \text{ and}$$

$$-47.47 \le b^* \le -36.78.$$

Thus, it is possible to provide sufficient image density while reducing the amount of toner deposited on the medium 18.

This makes it possible to downsize the toner cartridge 120C and printer 10.

Also, since the print color of an image is excellent when the image is viewed, it is possible to improve the color reproducibility of an image formed by superimposing the cyan toner and a toner of another color.

Next, a second embodiment of the present invention will be described. The second embodiment makes it possible, when an image is formed on a medium 18 with the cyan toner 140C, yellow toner 140Y, magenta toner 140M, and black toner 140K, to reduce the toner deposition amounts of the yellow toner 140Y, magenta toner 140M, and black toner 140K, and improve print colors. Parts having the same configurations as in the first embodiment are given the same reference characters, and advantages provided by the same mechanisms as in the first embodiment will not be described repeatedly.

Examples and comparative examples of the yellow toner 140Y as a yellow developer will be first described.

Example 10

First, 100 parts by weight of binder resin was added with 1.0 parts by weight of BONTRON E-84 (registered trademark) (manufactured by Orient Chemical Industries Co., Ltd.) serving as a charge control agent, 3.1 parts by weight of carnauba wax (Carnauba Wax No. 1 powder, manufactured by S. Kato & CO.) serving as a release agent, and 3.7 parts by weight of paraffin wax (HNP-11, manufactured by NIPPON SEIRO CO., LTD.) serving as a release agent, and mixed together with colorant using a Henschel mixer. Then, the resultant was melted and kneaded with a twin screw extruder, and cooled. After the cooling, the kneaded product was roughly pulverized with a cutter mill, and then pulverized with an impact type mill. Then, the pulverized product was classified with a pneumatic classifier, so that toner base particles having a predetermined particle diameter were obtained.

Then, in an external addition process, 3.0 parts by weight of hydrophobic silica (R972, manufactured by Nippon Aerosil Co., Ltd., having an average particle diameter of 16 nm) was added to 1 kg (100 parts by weight) of the toner base particles, and stirred for 3 minutes with a Henschel mixer, so that yellow toner Y-1 was produced.

Here, Pigment Yellow 185 (PY 185) was used as the colorant, and 20.0 parts by weight of Pigment Yellow 185 was added to the 100 parts by weight of the binder resin.

As the binder resin, a polyester resin was used. The binder resin was prepared with a twin screw extruder.

For yellow toner Y-1 of Example 10 produced as above, a measurement was made using the spectrophotometer (SE-2000, manufactured by Nippon Denshoku Industries Co., Ltd.) under the conditions of a C light source, a visual field of 2 degrees, and a reflection method. Specifically, the color (or powder color) of yellow toner Y-1 in a powder state was measured by putting 3.0 g of yellow toner Y-1 into a cylindrical measurement cell for powder (having a thickness of 2 mm and a diameter of 30 mm), which is an accessory of the spectrophotometer, vertically shaking the powder measurement cell once per second for 30 seconds with respect to the gravity direction to condense the yellow toner, and then measuring the lightness L*, hue a*, and hue b* of the yellow toner in the powder state. The lightness L*, hue a*, and hue b* of the powder color were as follows:

L*=87.12, a*=−7.60, b*=105.96.

Also, for yellow toner Y-1, measurements were made using the cell counter and analyzer, flow tester (CFT-500D, manufactured by Shimadzu Corporation), and differential scanning calorimeter (DSC6220, manufactured by Hitachi High-Tech Science Corporation). The volume median diameter D50 was 6.4 μm. The melting temperature T1/2 was 106.9° C. The first glass transition temperature Tg_1st was 54.6° C., and the second glass transition temperature Tg_2nd was 51.2° C.

Example 11

Yellow toner Y-2 was produced in the same manner as in Example 10. At this time, the amount of Pigment Yellow 185 was 20.0 parts by weight, and a polyester resin having an acid value lower than that of the binder resin of yellow toner Y-1 was used as the binder resin.

The lightness L*, hue a*, and hue b* of the powder color were as follows:

L*=87.14, a*=−4.14, b*=108.32.

The volume median diameter D50 was 6.4 μm, the melting temperature T1/2 was 107.8° C., the first glass transition temperature Tg_1st was 59.4° C., and the second glass transition temperature Tg_2nd was 52.4° C.

Example 12

Yellow toner Y-3 was produced in the same manner as in Example 10. At this time, the amount of Pigment Yellow 185 was 15.8 parts by weight, and a polyester resin having an acid value equal to that of the binder resin of yellow toner Y-1 was used as the binder resin.

The lightness L*, hue a*, and hue b* of the powder color were as follows:

L*=87.73, a*=−8.68, b*=105.62.

The volume median diameter D50 was 6.3 μm, the melting temperature T1/2 was 106.6° C., the first glass transition temperature Tg_1st was 62.2° C., and the second glass transition temperature Tg_2nd was 53.5° C.

Example 13

Yellow toner Y-4 was produced in the same manner as in Example 10. At this time, the amount of Pigment Yellow 185 was 15.8 parts by weight, and a polyester resin having an acid value lower than that of the binder resin of yellow toner Y-1 was used as the binder resin.

The lightness L*, hue a*, and hue b* of the powder color were as follows:

L*=87.81, a*=−5.39, b*=107.86.

The volume median diameter D50 was 6.5 μm, the melting temperature T1/2 was 108.1° C., the first glass transition temperature Tg_1st was 62.5° C., and the second glass transition temperature Tg_2nd was 54.0° C.

Example 14

Yellow toner Y-5 was produced in the same manner as in Example 10. At this time, the amount of Pigment Yellow 185 was 20.0 parts by weight, and a polyester resin having an acid value equal to that of the binder resin of yellow toner Y-1 was used as the binder resin.

The lightness L*, hue a*, and hue b* of the powder color were as follows:

L*=86.96, a*=−6.75, b*=106.73.

The volume median diameter D50 was 6.0 μm, the melting temperature T1/2 was 104.2° C., the first glass transition temperature Tg_1st was 56.1° C., and the second glass transition temperature Tg_2nd was 51.1° C.

Example 15

Yellow toner Y-6 was produced in the same manner as in Example 10. At this time, the amount of Pigment Yellow 185 was 20.0 parts by weight, and a polyester resin having an acid value lower than that of the binder resin of yellow toner Y-1 was used as the binder resin.

The lightness L*, hue a*, and hue b* of the powder color were as follows:

L*=87.43, a*=−5.33, b*=107.40.

The volume median diameter D50 was 6.4 μm, the melting temperature T1/2 was 108.8° C., the first glass transition temperature Tg_1st was 58.0° C., and the second glass transition temperature Tg_2nd was 52.4° C.

Comparative Example 1

Yellow toner Y-7 was produced in the same manner as in Example 10. At this time, the amount of Pigment Yellow 185 was 9.4 parts by weight, and a polyester resin having an acid value lower than that of the binder resin of yellow toner Y-1 was used as the binder resin.

The lightness L*, hue a*, and hue b* of the powder color were as follows:

L*=88.47, a*=−7.76, b*=106.88.

The volume median diameter D50 was 6.5 μm, the melting temperature T1/2 was 106.7° C., the first glass transition temperature Tg_1st was 60.5° C., and the second glass transition temperature Tg_2nd was 51.1° C.

Comparative Example 2

Yellow toner Y-8 was produced in the same manner as in Example 10. At this time, the amount of Pigment Yellow 185 was 9.4 parts by weight, and a polyester resin having an acid value lower than that of the binder resin of yellow toner Y-1 was used as the binder resin.

The lightness L*, hue a*, and hue b* of the powder color were as follows:

L*=89.28, a*=−9.10, b*=104.93.

The volume median diameter D50 was 6.3 μm, the melting temperature T1/2 was 105.8° C., the first glass transition temperature Tg_1st was 56.9° C., and the second glass transition temperature Tg_2nd was 54.2° C.

FIG. 15 shows the results of the measurements of the powder colors and physical properties of yellow toners Y-1 to Y-8.

Next, examples and comparative examples of the magenta toner 140M as a magenta developer will be described.

Example 16

First, 100 parts by weight of binder resin was added with 1.0 parts by weight of BONTRON E-84 (registered trademark) (manufactured by Orient Chemical Industries Co., Ltd.) serving as a charge control agent, 5.1 parts by weight of carnauba wax (Carnauba Wax No. 1 powder, manufactured by S. Kato & CO.) serving as a release agent, and 4.1 parts by weight of paraffin wax (HNP-11, manufactured by NIPPON SEIRO CO., LTD.) serving as a release agent, and mixed together with colorant using a Henschel mixer. Then, the resultant was melted and kneaded with a twin screw extruder, and cooled. After the cooling, the kneaded product was roughly pulverized with a cutter mill, and then pulverized with an impact type mill. Then, the pulverized product was classified with a pneumatic classifier, so that toner base particles having a predetermined particle diameter were obtained.

Then, in an external addition process, 3.0 parts by weight of hydrophobic silica (R972, manufactured by Nippon Aerosil Co., Ltd., having an average particle diameter of 16 nm) was added to 1 kg (100 parts by weight) of the toner base particles, and stirred for 3 minutes with a Henschel mixer, so that magenta toner M-1 was produced.

Here, quinacridone (QD) and Carmine 6B were used as the colorant, and 11.2 parts by weight of quinacridone and 7.5 parts by weight of Carmine 6B (CM) were added to the 100 parts by weight of binder resin, and thus the mixing ratio of the quinacridone and the Carmine 6B was 6:4. A polyester resin was used as the binder resin.

For magenta toner M-1 of Example 16 produced as above, a measurement was made using the spectrophotometer (SE-2000, manufactured by Nippon Denshoku Industries Co., Ltd.) under the conditions of a C light source, a visual field of 2 degrees, and a reflection method. Specifically, the color (or powder color) of magenta toner M-1 in a powder state was measured by putting 3.0 g of magenta toner M-1 into a cylindrical measurement cell for powder (having a thickness of 2 mm and a diameter of 30 mm), which is an accessory of the spectrophotometer, vertically shaking the powder measurement cell once per second for 30 seconds with respect to the gravity direction to condense the magenta toner, and then measuring the lightness L*, hue a*, and hue b* of the magenta toner in the powder state. The lightness L*, hue a*, and hue b* of the powder color were as follows:

L*=33.84, a*=58.72, b*=15.11.

Also, for magenta toner M-1, measurements were made using the cell counter and analyzer, flow tester (CFT-500D, manufactured by Shimadzu Corporation), and differential scanning calorimeter (DSC6220, manufactured by Hitachi High-Tech Science Corporation). The volume median diameter D50 was 6.2 μm. The melting temperature T1/2 was 108.6° C. The first glass transition temperature Tg_1st was 61.8° C., and the second glass transition temperature Tg_2nd was 52.8° C.

Example 17

Magenta toner M-2 was produced in the same manner as in Example 16. At this time, the amount of quinacridone was 11.2 parts by weight, the amount of Carmine 6B (CM) was 7.5 parts by weight, and a polyester resin having an acid value equal to that of the binder resin of magenta toner M-1 was used as the binder resin.

The lightness L*, hue a*, and hue b* of the powder color were as follows:

L*=35.53, a*=60.46, b*=12.87.

The volume median diameter D50 was 6.0 μm, the melting temperature T1/2 was 112.7° C., the first glass transition temperature Tg_1st was 63.6° C., and the second glass transition temperature Tg_2nd was 54.4° C.

Example 18

Magenta toner M-3 was produced in the same manner as in Example 16. At this time, the amount of quinacridone was 11.2 parts by weight, the amount of Carmine 6B (CM) was 7.5 parts by weight, and a polyester resin having an acid value equal to that of the binder resin of magenta toner M-1 was used as the binder resin.

The lightness L*, hue a*, and hue b* of the powder color were as follows:

L*=34.70, a*=59.11, b*=17.30.

The volume median diameter D50 was 6.5 μm, the melting temperature T1/2 was 112.2° C., the first glass transition temperature Tg_1st was 64.1° C., and the second glass transition temperature Tg_2nd was 55.3° C.

Example 19

Magenta toner M-4 was produced in the same manner as in Example 16. At this time, the amount of quinacridone was 12.1 parts by weight, the amount of Carmine 6B was 8.1 parts by weight, and a polyester resin having an acid value equal to that of the binder resin of magenta toner M-1 was used as the binder resin.

The lightness L*, hue a*, and hue b* of the powder color were as follows:

L*=35.30, a*=60.55, b*=13.37.

The volume median diameter D50 was 6.3 μm, the melting temperature T1/2 was 111.6° C., the first glass transition temperature Tg_1st was 63.8° C., and the second glass transition temperature Tg_2nd was 55.5° C.

Example 20

Magenta toner M-5 was produced in the same manner as in Example 16. At this time, the amount of quinacridone was 14.4 parts by weight, the amount of Carmine 6B was 9.6 parts by weight, and a polyester resin having an acid value equal to that of the binder resin of magenta toner M-1 was used as the binder resin.

The lightness L*, hue a*, and hue b* of the powder color were as follows:

L*=34.28, a*=59.11, b*=15.81.

The volume median diameter D50 was 6.0 μm, the melting temperature T1/2 was 111.7° C., the first glass transition temperature Tg_1st was 56.9° C., and the second glass transition temperature Tg_2nd was 54.8° C.

Example 21

Magenta toner M-6 was produced in the same manner as in Example 16. At this time, the amount of quinacridone was 8.4 parts by weight, the amount of Carmine 6B was 5.6 parts by weight, and a polyester resin having an acid value equal to that of the binder resin of magenta toner M-1 was used as the binder resin.

The lightness L*, hue a*, and hue b* of the powder color were as follows:

L*=36.51, a*=61.47, b*=11.71.

The volume median diameter D50 was 6.5 μm, the melting temperature T1/2 was 111.6° C., the first glass transition temperature Tg_1st was 57.4° C., and the second glass transition temperature Tg_2nd was 54.7° C.

Comparative Example 3

Magenta toner M-7 was produced in the same manner as in Example 16. At this time, the amount of quinacridone was 5.7 parts by weight, the amount of Carmine 6B was 3.8 parts by weight, and a polyester resin having an acid value equal to that of the binder resin of magenta toner M-1 was used as the binder resin.

The lightness L*, hue a*, and hue b* of the powder color were as follows:

L*=38.61, a*=63.71, b*=7.35.

The volume median diameter D50 was 6.4 μm, the melting temperature T1/2 was 110.5° C., the first glass transition temperature Tg_1st was 61.8° C., and the second glass transition temperature Tg_2nd was 55.8° C.

Comparative Example 4

Magenta toner M-8 was produced in the same manner as in Example 16. At this time, the amount of quinacridone was 5.7 parts by weight, the amount of Carmine 6B was 3.8 parts by weight, and a polyester resin having an acid value equal to that of the binder resin of magenta toner M-1 was used as the binder resin.

The lightness L*, hue a*, and hue b* of the powder color were as follows:

L*=39.68, a*=63.48, b*=5.95.

The volume median diameter D50 was 6.4 μm, the melting temperature T1/2 was 108.5° C., the first glass transition temperature Tg_1st was 56.7° C., and the second glass transition temperature Tg_2nd was 55.0° C.

FIG. 16 shows the results of the measurements of the powder colors and physical properties of magenta toners M-1 to M-8.

Next, examples and comparative examples of the black toner 140K as a black developer will be described.

Example 22

First, 100 parts by weight of binder resin was added with 0.3 parts by weight of BONTRON E-84 (registered trademark) (manufactured by Orient Chemical Industries Co., Ltd.) serving as a charge control agent, 3.9 parts by weight of carnauba wax (Carnauba Wax No. 1 powder, manufactured by S. Kato & CO.) serving as a release agent, and 3.4 parts by weight of paraffin wax (HNP-11, manufactured by NIPPON SEIRO CO., LTD.) serving as a release agent, and mixed together with colorant using a Henschel mixer. Then, the resultant was melted and kneaded with a twin screw extruder, and cooled. After the cooling, the kneaded product was roughly pulverized with a cutter mill, and then pulverized with an impact type mill. Then, the pulverized product was classified with a pneumatic classifier, so that toner base particles having a predetermined particle diameter were obtained.

Then, in an external addition process, 3.0 parts by weight of hydrophobic silica (R972, manufactured by Nippon Aerosil Co., Ltd., having an average particle diameter of 16 nm) was added to 1 kg (100 parts by weight) of the toner base particles, and stirred for 3 minutes with a Henschel mixer, so that black toner K-1 was produced.

Here, carbon black (CB) was used as the colorant, and 10.5 parts by weight of carbon black, 0.3 parts by weight of the charge control agent (BONTRON E-84, manufactured by Orient Chemical Industries Co., Ltd.), and 0.19 parts by weight of an antistatic agent were added to the 100 parts by weight of binder resin. A polyester resin was used as the binder resin.

For black toner K-1 of Example 22 produced as above, a measurement was made using the spectrophotometer (SE-2000, manufactured by Nippon Denshoku Industries Co., Ltd.) under the conditions of a C light source, a visual field of 2 degrees, and a reflection method. Specifically, the color (or powder color) of black toner K-1 in a powder state was measured by putting 3.0 g of black toner K-1 into a cylindrical measurement cell for powder (having a thickness of 2 mm and a diameter of 30 mm), which is an accessory of the spectrophotometer, vertically shaking the powder measurement cell once per second for 30 seconds with respect to the gravity direction to condense the black toner, and then measuring the lightness L*, hue a*, and hue b* of the black toner in the powder state. The lightness L*, hue a*, and hue b* of the powder color were as follows:

L*=11.14, a*=0.00, b*=−0.27.

Also, for black toner K-1, measurements were made using the cell counter and analyzer, flow tester (CFT-500D, manufactured by Shimadzu Corporation), and differential scanning calorimeter (DSC6220, manufactured by Hitachi High-Tech Science Corporation). The volume median diameter D50 was 6.4 μm. The melting temperature T1/2 was 108.3° C. The first glass transition temperature Tg_1st was 61.8° C., and the second glass transition temperature Tg_2nd was 54.9° C.

Example 23

Black toner K-2 was produced in the same manner as in Example 22. At this time, the amount of carbon black was 10.5 parts by weight, the amount of charge control agent was 0.3 parts by weight, and the amount of antistatic agent was 0.06 parts by weight.

The lightness L*, hue a*, and hue b* of the powder color were as follows:

L*=10.59, a*=0.12, b*=−0.22.

The volume median diameter D50 was 6.3 μm, the melting temperature T1/2 was 105.7° C., the first glass transition temperature Tg_1st was 60.7° C., and the second glass transition temperature Tg_2nd was 54.3° C.

Example 24

Black toner K-3 was produced in the same manner as in Example 22. At this time, the amount of carbon black was 10.5 parts by weight, the amount of charge control agent was 0.3 parts by weight, and the amount of antistatic agent was 0.06 parts by weight.

The lightness L*, hue a*, and hue b* of the powder color were as follows:

L*=11.01, a*=0.16, b*=−0.39.

The volume median diameter D50 was 6.5 μm, the melting temperature T1/2 was 106.6° C., the first glass transition temperature Tg_1st was 59.8° C., and the second glass transition temperature Tg_2nd was 55.4° C.

Example 25

Black toner K-4 was produced in the same manner as in Example 22. At this time, the amount of carbon black was 13.4 parts by weight, the amount of charge control agent was 1.3 parts by weight, and the amount of antistatic agent was 0.03 parts by weight.

The lightness L*, hue a*, and hue b* of the powder color were as follows:

L*=11.13, a*=−0.01, b*=−0.52.

The volume median diameter D50 was 6.5 μm, the melting temperature T1/2 was 108.0° C., the first glass transition temperature Tg_1st was 58.0° C., and the second glass transition temperature Tg_2nd was 54.5° C.

Example 26

Black toner K-5 was produced in the same manner as in Example 22. At this time, the amount of carbon black was 10.5 parts by weight, the amount of charge control agent was 0.6 parts by weight, and the amount of antistatic agent was 0.06 parts by weight.

The lightness L*, hue a*, and hue b* of the powder color were as follows:

L*=11.35, a*=0.21, b*=−0.30.

The volume median diameter D50 was 6.0 μm, the melting temperature T1/2 was 105.4° C., the first glass transition temperature Tg_1st was 56.2° C., and the second glass transition temperature Tg_2nd was 52.1° C.

Example 27

Black toner K-6 was produced in the same manner as in Example 22. At this time, the amount of carbon black was 10.5 parts by weight, the amount of charge control agent was 0.6 parts by weight, and the amount of antistatic agent was 0.06 parts by weight.

The lightness L*, hue a*, and hue b* of the powder color were as follows:

L*=11.08, a*=0.19, b*=−0.14.

The volume median diameter D50 was 6.0 μm, the melting temperature T1/2 was 109.6° C., the first glass transition temperature Tg_1st was 58.0° C., and the second glass transition temperature Tg_2nd was 53.9° C.

Comparative Example 5

Black toner K-7 was produced in the same manner as in Example 22. At this time, the amount of carbon black was 7.3 parts by weight, the amount of charge control agent was 1.2 parts by weight, and the amount of antistatic agent was 0.03 parts by weight.

The lightness L*, hue a*, and hue b* of the powder color were as follows:

L*=11.67, a*=0.34, b*=0.01.

The volume median diameter D50 was 6.5 μm, the melting temperature T1/2 was 106.8° C., the first glass transition temperature Tg_1st was 60.7° C., and the second glass transition temperature Tg_2nd was 53.3° C.

Comparative Example 6

Black toner K-8 was produced in the same manner as in Example 22. At this time, the amount of carbon black was 7.3 parts by weight, the amount of charge control agent was 1.2 parts by weight, and the amount of antistatic agent was 0.03 parts by weight.

The lightness L*, hue a*, and hue b* of the powder color were as follows:

L*=12.87, a*=0.31, b*=0.01.

The volume median diameter D50 was 6.4 μm, the melting temperature T1/2 was 105.6° C., the first glass transition temperature Tg_1st was 58.8° C., and the second glass transition temperature Tg_2nd was 55.2° C.

FIG. 17 shows the results of the measurements of the powder colors and physical properties of black toners K-1 to K-8.

For each of yellow toners Y-1 to Y-8, magenta toners M-1 to M-8, and black toners K-1 to K-8, image densities were measured relative to the toner deposition amount as follows.

In this case, a color LED printer (C833, manufactured by Oki Data Corporation) was used.

When the image densities of yellow toners Y-1 to Y-8 were measured relative to the toner deposition amount, yellow toners Y-1 to Y-8 were used as the yellow toner 140Y, and black, magenta, and cyan toners in toner cartridges 120 mounted in the color LED printer were used as the black toner 140K, magenta toner 140M, and cyan toner 140C.

When the image densities of magenta toners M-1 to M-8 were measured relative to the toner deposition amount, magenta toners M-1 to M-8 were used as the magenta toner 140M, and black, yellow, and cyan toners in toner cartridges 120 mounted in the color LED printer were used as the black toner 140K, yellow toner 140Y, and cyan toner 140C.

When the image densities of black toners K-1 to K-8 were measured relative to the toner deposition amount, black toners K-1 to K-8 were used as the black toner 140K, and magenta, yellow, and cyan toners in toner cartridges 120 mounted in the color LED printer were used as the magenta toner 140M, yellow toner 140Y, and cyan toner 140C.

Here, the lightness L*, hue a*, and hue b* of the powder color of each of the cyan toner 140C, yellow toner 140Y, magenta toner 140M, and black toner 140K of the color LED printer were as follows.

The powder color of the cyan toner 140C was

L*=35.11, a*=−4.35, b*=−46.26.

The powder color of the yellow toner 140Y was

L*=88.47, a*=−7.76, b*=106.88.

The powder color of the magenta toner 140M was

L*=39.68, a*=63.48, b*=5.95.

The powder color of the black toner 140K was

L*=11.67, a*=0.34, b*=0.01.

Excellent White A4 (manufactured by Oki Data Corporation, having a ream weight of 70 kg, and having a basis weight of 80 g/m$^2$) was used as the medium 18.

In the same manner as in the first embodiment, a yellow density measurement print pattern, a magenta density measurement print pattern, a black density measurement print pattern were formed on media 18 at a print duty of 100%; the image densities of the measurement regions were measured with the densitometer (X-Rite 528, manufactured by X-Rite Inc.); the toner deposition amounts of the measurement regions were measured with double-sided tape; and through linear approximations of the image densities and toner deposition amounts to linear functions, the image densities at toner deposition amounts of 0.31 mg/cm$^2$ and 0.35 mg/cm$^2$ were calculated for yellow toners Y-1 to Y-8, the image densities at toner deposition amounts of 0.32 mg/cm$^2$ and 0.35 mg/cm$^2$ were calculated for magenta toners M-1 to M-8, and the image densities at toner deposition amounts of 0.29 mg/cm$^2$ and 0.35 mg/cm$^2$ were calculated for black toners K-1 to K-8.

The values of 0.31 mg/cm$^2$, 0.35 mg/cm$^2$, 0.32 mg/cm$^2$, and 0.29 mg/cm$^2$ were set within the range of 0.20 to 0.45 mg/cm$^2$ as indexes for reducing the toner deposition amounts.

FIG. 18 shows, for each of yellow toners Y-1 to Y-8, the results of the measurements and evaluations of the image densities relative to the toner deposition amount. FIG. 19 shows, for each of magenta toners M-1 to M-8, the results of the measurements and evaluations of the image densities relative to the toner deposition amount. FIG. 20 shows, for each of black toners K-1 to K-8, the results of the measurements and evaluations of the image densities relative to the toner deposition amount.

For each of yellow toners Y-1 to Y-8, magenta toners M-1 to M-8, and black toners K-1 to K-8, it can be seen that the higher the value of an image density, the higher the density of the printed product, and the better the result of evaluation of the image density relative to the toner deposition amount. Each of the image densities was evaluated as "excellent" when it was greater than or equal to 1.50, "good" when it was greater than or equal to 1.40 and less than 1.50, and "poor" when it was less than 1.40. That is, each image density was rated as "excellent" if image density≥1.50, "good" if 1.40≤image density<1.50, and "poor" if 1.40>image density.

In this embodiment, for yellow toners Y-1 to Y-6, the image density at a toner deposition amount of 0.35 mg/cm$^2$ was greater than or equal to 1.50. For yellow toners Y-1 to Y-3, the image density at a toner deposition amount of 0.31 mg/cm$^2$ was greater than or equal to 1.50.

For magenta toners M-1 to M-6, the image density at a toner deposition amount of 0.35 mg/cm$^2$ was greater than or equal to 1.50. For magenta toners M-1 to M-3, the image density at a toner deposition amount of 0.32 mg/cm$^2$ was greater than or equal to 1.50.

For black toners K-1 to K-6, the image density at a toner deposition amount of 0.35 mg/cm$^2$ was greater than or equal to 1.50. For black toners K-1 to K-3, the image density at a toner deposition amount of 0.29 mg/cm$^2$ was greater than or equal to 1.50.

For each of yellow toners Y-1 to Y-8, magenta toners M-1 to M-8, and black toners K-1 to K-8, print colors of a printed product were measured as follows.

In this case, the color LED printer (C833, manufactured by Oki Data Corporation) was used.

When the print colors of the printed products of yellow toners Y-1 to Y-8 were measured, yellow toners Y-1 to Y-8 were used as the yellow toner 140Y, and black, magenta, and cyan toners in toner cartridges 120 mounted in the color LED printer were used as the black toner 140K, magenta toner 140M, and cyan toner 140C.

When the print colors of the printed products of magenta toners M-1 to M-8 were measured, magenta toners M-1 to M-8 were used as the magenta toner 140M, and black, yellow, and cyan toners in toner cartridges 120 mounted in the color LED printer were used as the black toner 140K, yellow toner 140Y, and cyan toner 140C.

When the print colors of the printed products of black toners K-1 to K-8 were measured, black toners K-1 to K-8 were used as the black toner 140K, and magenta, yellow, and cyan toners in toner cartridges 120 mounted in the color LED printer were used as the magenta toner 140M, yellow toner 140Y, and cyan toner 140C.

Excellent White A4 (manufactured by Oki Data Corporation, having a ream weight of 70 kg, and having a basis weight of 80 g/m$^2$) was used as the medium 18.

In the same manner as in the first embodiment, the developing voltages of the developing rollers 104 of the image forming units 12 were adjusted so that when the print color measurement print pattern was printed, the average of the image densities of the five 100%-density yellow patches Py was 1.50, the average of the image densities of the five 100%-density magenta patches Pm was 1.50, the average of the image densities of the five 100%-density cyan patches Pc was 1.50, and the average of the image densities of the five 100%-density black patches Pk was 1.50; and print colors of yellow toners Y-1 to Y-8, magenta toners M-1 to M-8, and black toners K-1 to K-8 were measured using the densitometer X-rite 528.

Specifically, for each of yellow toners Y-1 to Y-8, the print colors of the five red patches Pr, five yellow patches Py, and five green patches Pg on a printed product with the print color measurement print pattern formed thereon were measured, and the average print color of the red patches Pr, the average print color of the yellow patches Py, and the average print color of the green patches Pg were calculated. Then, for each of red, yellow, and green, the color difference ΔE between the average print color and a reference color was calculated. The reference color was a color having a lightness L*, a hue a*, and a hue b* of a print sample awarded Japan Color Certification measured under the above-described print color measurement conditions.

For each of magenta toners M-1 to M-8, the print colors of the five red patches Pr, five magenta patches Pm, and five blue patches Pb on a printed product with the print color measurement print pattern formed thereon were measured, and the average print color of the red patches Pr, the average print color of the magenta patches Pm, and the average print color of the blue patches Pb were calculated. Then, for each of red, magenta, and blue, the color difference ΔE between the average print color and a reference color was calculated. The reference color was a color having a lightness L*, a hue a*, and a hue b* of a print sample awarded Japan Color Certification measured under the above-described print color measurement conditions.

For each of black toners K-1 to K-8, the print colors of the five black patches Pk on a printed product with the print color measurement print pattern formed thereon were measured, and the average print color of the black patches Pk was calculated. Then, the color difference ΔE between the average print color and a predetermined reference color was calculated.

The lightnesses L*, hues a*, and hues b* of the reference colors were specifically as follows:

L*=46.3, a*=69.0, b*=45.5 for red,

L*=46.1, a*=75.8, b*=−3.2 for magenta,

L*=22.0, a*=20.0, b*=−47.7 for blue,

L*=53.4, a*=−36.3, b*=−51.5 for cyan,

L*=47.7, a*=−70.6, b*=22.4 for green,

L*=88.5, a*=−6.2, b*=93.5 for yellow, and

L*=20.6, a*=1.9, b*=1.9 for black.

FIG. 21 shows, for each of yellow toners Y-1 to Y-8 and for each of red (R), yellow (Y), and green (G), the lightness L*, hue a*, and hue b* of the average print color, the color difference ΔE between the average print color and the reference color, and the result of evaluation of the print color.

FIG. 22 shows, for each of magenta toners M-1 to M-8 and for each of red (R), magenta (M), and blue (B), the lightness L*, hue a*, and hue b* of the average print color, the color difference ΔE between the average print color and the reference color, and the result of evaluation of the print color.

FIG. 23 shows, for each of black toners K-1 to K-8, the lightness L*, hue a*, and hue b* of the average print color, the color difference ΔE between the average print color and the reference color, and the result of evaluation of the print color.

For each color difference ΔE, when the color difference ΔE was less than or equal to 16.0, since the print color was visually excellent, the print color was evaluated as "excellent"; when the color difference ΔE was greater than 16.0 and less than or equal to 20.0, since it was determined by visual evaluation that there was no practical problem, the print color was evaluated as "good"; when the color difference ΔE was greater than 20.0, since it was determined by visual evaluation that there was a practical problem, the print color was evaluated as "poor". That is, the print color was rated as "excellent" if ΔE≤16.0, "good" if 16.0<ΔE≤20.0, and "poor" if 20.0<ΔE.

For yellow toners Y-1 to Y-8, magenta toners M-1 to M-8, and black toners K-1 to K-8, the color differences ΔE between the average print colors and the reference colors were all less than or equal to 16.0, and the evaluation results were all "excellent".

FIG. 24 shows, for each of yellow toners Y-1 to Y-8, a comprehensive evaluation based on the evaluation results of the image densities (in FIG. 18) and the evaluation results of the print colors (in FIG. 21). FIG. 25 shows, for each of magenta toners M-1 to M-8, a comprehensive evaluation based on the evaluation results of the image densities (in FIG. 19) and the evaluation results of the print colors (in FIG. 22). FIG. 26 shows, for each of black toners K-1 to K-8, a comprehensive evaluation based on the evaluation results of the image densities (in FIG. 20) and the evaluation results of the print colors (in FIG. 23). Each toner was comprehensively evaluated as "A" when all the evaluation results were "excellent", "B" when all the evaluation results were not "poor" but at least one of the evaluation results was "good", and "C" when at least one of the evaluation results was "poor".

Specifically, in FIG. 24, the comprehensive evaluations of yellow toners Y-1 to Y-3 were "A", the comprehensive evaluations of yellow toners Y-4 to Y-6 were "B", and the comprehensive evaluations of yellow toners Y-7 and Y-8 were "C". In FIG. 25, the comprehensive evaluations of magenta toners M-1 to M-3 were "A", the comprehensive evaluations of magenta toners M-4 to M-6 were "B", and the comprehensive evaluations of magenta toners M-7 and M-8 were "C". In FIG. 26, the comprehensive evaluations of black toners K-1 to K-3 were "A", the comprehensive evaluations of black toners K-4 to K-6 were "B", and the comprehensive evaluations of black toners K-7 and K-8 were "C".

Here, for yellow toners Y-1 to Y-3, the image density at a toner deposition amount of 0.31 mg/cm$^2$ was greater than or equal to 1.50.

Thus, when the lightness L*, hue a*, and hue b* of a yellow toner in a powder state satisfy $$87.12 \le L^* \le 87.73,$$

$$-8.68 \le a^* \le -4.14, \text{ and}$$

$$105.62 \le b^* \le 108.32,$$

it is possible to provide sufficient image density at a toner deposition amount of 0.31 mg/cm$^2$, and provide an excellent print color when an image is printed by superimposing the yellow toner and a toner of another color.

Also, for yellow toners Y-1 to Y-6, the image density at a toner deposition amount of 0.35 mg/cm$^2$ was greater than or equal to 1.50.

Thus, when the lightness L*, hue a*, and hue b* of a yellow toner in a powder state satisfy $$86.96 \le L^* \le 87.81,$$

$$-8.68 \le a^* \le -4.14, \text{ and}$$

$$105.62 \le b^* \le 108.32,$$

it is possible to provide sufficient image density at a toner deposition amount of 0.35 mg/cm$^2$, and provide an excellent print color when an image is printed by superimposing the yellow toner and a toner of another color. For yellow toners Y-1 to Y-6, it is conceivable that since the amount of yellow pigment was large and the lightness L* was low, the image density was high and the print color was excellent.

For magenta toners M-1 to M-3, the image density at a toner deposition amount of 0.32 mg/cm$^2$ was greater than or equal to 1.50.

Thus, when the lightness L*, hue a*, and hue b* of a magenta toner in a powder state satisfy $$33.84 \le L^* \le 35.53,$$

$$58.72 \le a^* \le 60.46, \text{ and}$$

$$12.87 \le b^* \le 17.30,$$

it is possible to provide sufficient image density at a toner deposition amount of 0.32 mg/cm$^2$, and provide an excellent print color when an image is printed by superimposing the magenta toner and a toner of another color.

Also, for magenta toners M-1 to M-6, the image density at a toner deposition amount of 0.35 mg/cm$^2$ was greater than or equal to 1.50.

Thus, when the lightness L*, hue a*, and hue b* of a magenta toner in a powder state satisfy $$33.84 \leq L^* \leq 36.51,$$

$$58.72 \leq a^* \leq 61.47, \text{ and}$$

$$11.71 \leq b^* \leq 17.30,$$

it is possible to provide sufficient image density at a toner deposition amount of 0.35 mg/cm$^2$, and provide an excellent print color when an image is printed by superimposing the magenta toner and a toner of another color. For magenta toners M-1 to M-6, it is conceivable that since the amount of magenta pigment was large and the lightness L* was low, the image density was high and the print color was excellent.

For black toners K-1 to K-3, the image density at a toner deposition amount of 0.29 mg/cm$^2$ was greater than or equal to 1.50.

Thus, when the lightness L*, hue a*, and hue b* of a black toner in a powder state satisfy $$10.59 \leq L^* \leq 11.14,$$

$$0.0 \leq a^* \leq 0.16, \text{ and}$$

$$-0.39 \leq b^* \leq -0.22,$$

it is possible to provide sufficient image density at a toner deposition amount of 0.29 mg/cm$^2$, and provide an excellent print color when an image is printed by superimposing the black toner and a toner of another color.

Also, for black toners K-1 to K-6, the image density at a toner deposition amount of 0.35 mg/cm$^2$ was greater than or equal to 1.50.

Thus, when the lightness L*, hue a*, and hue b* of a black toner in a powder state satisfy $$10.59 \leq L^* \leq 11.35,$$

$$-0.01 \leq a^* \leq 0.21, \text{ and}$$

$$-0.52 \leq b^* \leq -0.14,$$

it is possible to provide sufficient image density at a toner deposition amount of 0.35 mg/cm$^2$, and provide an excellent print color when an image is printed by superimposing the magenta toner and a toner of another color. For black toners K-1 to K-6, it is conceivable that since the amount of black pigment was large and the lightness L* was low, the image density was high and the print color was excellent.

Next, a case in which an image is formed on a medium 18 using a color toner set including one of cyan toners C-1 to C-7, one of yellow toners Y-1 to Y-6, and one of magenta toners M-1 to M-6.

In this case, the print color measurement print pattern was formed on a medium 18 with cyan toner C-3, yellow toner Y-1, and Magenta toner M-3, which were all comprehensively evaluated as "A", and image densities and print colors were measured and evaluated.

Specifically, the image densities of the five 100%-density cyan patches Pc (each of which was a cyan toner image formed at a print duty of 100%), five 100%-density yellow patches Py (each of which was a yellow toner image formed at a print duty of 100%), five 100%-density magenta patches Pm (each of which was a magenta toner image formed at a print duty of 100%), five 200%-density red patches Pr (each of which was the combination of a yellow toner image formed at a print duty of 100% and a magenta toner image formed at a print duty of 100%), five 200%-density green patches Pg (each of which was the combination of a cyan toner image formed at a print duty of 100% and a yellow toner image formed at a print duty of 100%), and five 200%-density blue patches Pb (each of which was the combination of a cyan toner image formed at a print duty of 100% and a magenta toner image formed at a print duty of 100%) were measured. Then, for each of cyan, yellow, magenta, red, green, and blue, the average of the measured image densities of the five patches was calculated as an average image density. Also, for each of cyan, yellow, magenta, red, green, and blue, the lightnesses L*, hues a*, and hues b* of the print colors of the five patches were measured, the average of the measured print colors of the five patches was calculated as an average print color, and the color difference ΔE between the average print color and the above-described reference color measured from the print sample awarded Japan Color Certification was calculated.

FIG. 27 shows, for each color, the image density, the average print color, the color difference ΔE, and the result of evaluation of the print color.

For each color, the evaluation was made as follows. When the color difference ΔE was less than or equal to 16.0, since the print color was visually excellent, the print color was evaluated as "excellent"; when the color difference ΔE was greater than 16.0 and less than or equal to 20.0, since it was determined by visual evaluation that there was no practical problem, the print color was evaluated as "good"; when the color difference ΔE was greater than 20.0, since it was determined by visual evaluation that there was a practical problem, the print color was evaluated as "poor". That is, the print color was rated as "excellent" if $\Delta E \leq 16.0$, "good" if $16.0 < \Delta E \leq 20.0$, and "poor" if $20.0 < \Delta E$.

For each color, the color difference ΔE between the average print color and the reference color was less than or equal to 16.0, and the evaluation result was "excellent".

Figure 10:
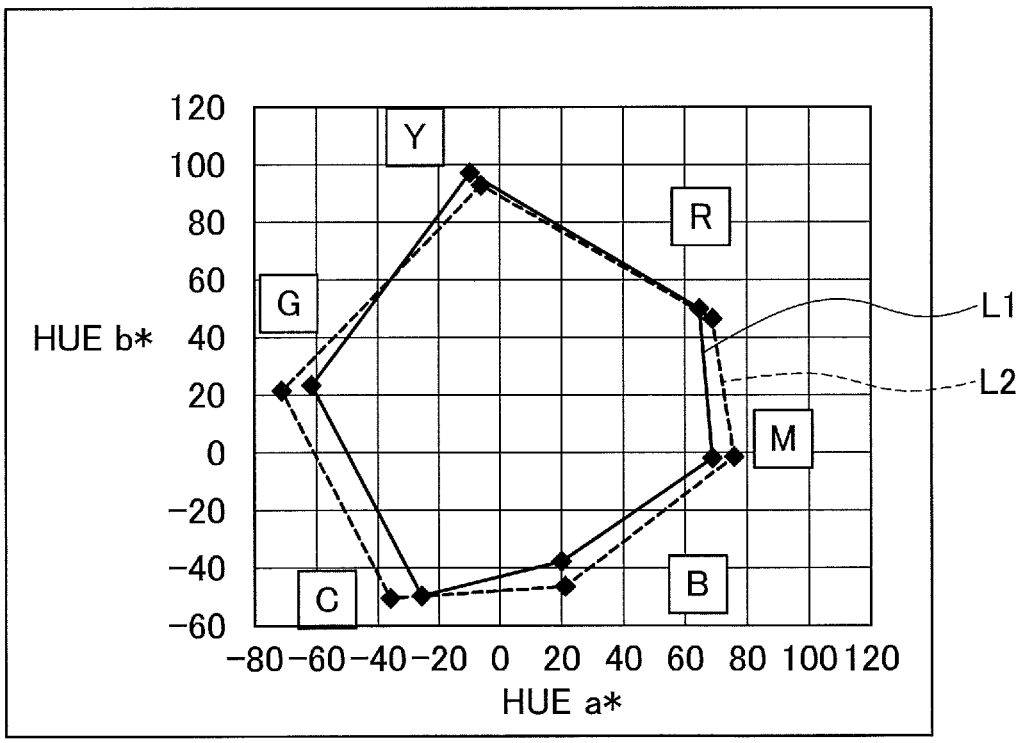
FIG. 10 is a conceptual diagram illustrating average print colors and reference colors in a second embodiment of the present invention.

FIG. 10 is a conceptual diagram illustrating the average print colors and the reference colors in the second embodiment of the present invention. The horizontal axis represents hue a*, and the vertical axis represents hue b*.

In FIG. 10, solid line L1 indicates the average print colors, and dashed line L2 indicates the reference colors.

In this embodiment, the toner cartridge 120Y stores a yellow toner (e.g., yellow toners Y-1 to Y-6) having, in a powder state, a lightness L*, a hue a*, and a hue b* satisfying $$86.96 \leq L^* \leq 87.81,$$

$$-8.68 \leq a^* \leq -4.14, \text{ and}$$

$$105.62 \leq b^* \leq 108.32.$$

Thus, it is possible to provide sufficient image density while reducing the amount of toner deposited on a medium 18.

Also, the toner cartridge 120M stores a magenta toner (e.g., magenta toners M-1 to M-6) having, in a powder state, a lightness L*, a hue a*, and a hue b* satisfying $$33.84 \leq L^* \leq 36.51,$$

$$58.72 \leq a^* \leq 61.47, \text{ and}$$

$$11.71 \leq b^* \leq 17.30.$$

Thus, it is possible to provide sufficient image density while reducing the amount of toner deposited on a medium 18.

Further, the toner cartridge 120K stores a black toner (e.g., black toners K-1 to K-6) having, in a powder state, a lightness L*, a hue a*, and a hue b* satisfying $$10.59 \leq L^* \leq 11.35,$$

$$-0.01 \leq a^* \leq 0.21, \text{ and}$$

$$-0.52 \leq b^* \leq -0.14.$$

Thus, it is possible to provide sufficient image density while reducing the amount of toner deposited on a medium 18.

In each of the above embodiments, the printer 10, which is of a direct transfer type and directly transfers toner images onto a medium 18, has been described as an image forming apparatus. However, the present invention is applicable to a printer of an intermediate transfer type that transfers toner images from photosensitive drums onto an intermediate transfer belt by primary transfer and transfers the toner images from the intermediate transfer belt onto a medium 18 by secondary transfer.

Also, the present invention is applicable to various image forming apparatuses, such as copiers, facsimile machines, and multi-function peripherals (MFPs).

The present invention is not limited to the embodiments described above; it can be practiced in various other aspects without departing from the invention scope.

What is claimed is:

1. A toner container used in an image forming apparatus including an exposure unit with a light emitting diode light source, the toner container comprising:

a container body; and a cyan toner stored in the container body, wherein the cyan toner comprises a binder resin and at least one pigment, wherein the at least one pigment includes at least Pigment Blue 15:3 and Pigment Green 7, and wherein a lightness L*, a hue a*, and a hue b* of the cyan toner in a powder state satisfy $$30.04 \leq L^* \leq 33.68,$$

$$-1.75 \leq a^* \leq 0.71, \text{ and}$$

$$-47.47 \leq b^* \leq -45.08.$$

2. The toner container of claim 1, wherein a total content of the Pigment Blue 15:3 and the Pigment Green 7 is greater than or equal to 6.1 parts by weight based on 100 parts by weight of the binder resin.

3. The toner container of claim 1, wherein a mixing ratio of the Pigment Green 7 to the Pigment Blue 15:3 is greater than or equal to 0.09 and less than or equal to 0.10.

4. The toner container of claim 1, further comprising a yellow toner comprising a binder resin and at least one pigment, wherein the at least one pigment includes at least Pigment Yellow 185, and wherein a lightness L*, a hue a*, and a hue b* of the yellow toner in a powder state satisfy $$86.96 \leq L^* \leq 87.81,$$

$$-8.68 \leq a^* \leq -4.14, \text{ and}$$

$$105.62 \leq b^* \leq 108.32.$$

5. The toner container of claim 1, further comprising a magenta toner comprising a binder resin and at least one pigment, wherein the at least one pigment includes at least quinacridone and Carmine 6B, and wherein a lightness L*, a hue a*, and a hue b* of the magenta toner in a powder state satisfy $$33.84 \leq L^* \leq 36.51,$$

$$58.72 \leq a^* \leq 61.47, \text{ and}$$

$$11.71 \leq b^* \leq 17.30.$$

6. The toner container of claim 4, further comprising a carrier together with the yellow toner.

7. The toner container of claim 5, further comprising a carrier together with the magenta toner.

8. An image forming unit comprising:

the toner container of claim 1; and a process portion that forms a toner image with the cyan toner stored in the toner container.

9. An image forming apparatus comprising the image forming unit of claim 8.

10. The toner container of claim 1, further comprising a carrier together with the cyan toner.

11. An image forming apparatus comprising:

a cyan toner comprising a binder resin and at least one pigment, the at least one pigment including at least Pigment Blue 15:3 and Pigment Green 7, a lightness L*, a hue a*, and a hue b* of the cyan toner in a powder state satisfying $$30.04 \leq L^* \leq 33.68,$$

$$-1.75 \leq a^* \leq 0.71, \text{ and}$$

$$-47.47 \leq b^* \leq -45.08;$$

a toner carrier that develops an electrostatic latent image with the cyan toner to form a toner image;

a transfer unit that transfers the toner image onto a medium; and a fixing device that fixes the toner image to the medium to form a printed product.

12. The image forming apparatus of claim 11, further comprising:

a yellow toner comprising a binder resin and at least one pigment, the at least one pigment including at least Pigment Yellow 185, a lightness L*, a hue a*, and a hue b* of the yellow toner in a powder state satisfying $$86.96 \leq L^* \leq 87.81,$$

$$-8.68 \leq a^* \leq -4.14, \text{ and}$$

$$105.62 \leq b^* \leq 108.32; \text{ and}$$

a yellow toner carrier that develops an electrostatic latent image for yellow with the yellow toner to form a toner image.

13. The image forming apparatus of claim 11, further comprising:

a magenta toner comprising a binder resin and at least one pigment, the at least one pigment including at least quinacridone and Carmine 6B, a lightness L*, a hue a*, and a hue b* of the magenta toner in a powder state satisfying $$33.84 \leq L^* \leq 36.51,$$

$$58.72 \leq a^* \leq 61.47, \text{ and}$$

$11.71 \leq b^* \leq 17.30$; and a magenta toner carrier that develops an electrostatic latent image for magenta with the magenta toner to form a toner image.

14. The image forming apparatus of claim 11, further comprising:

a black toner comprising a binder resin and carbon black, a lightness L*, a hue a*, and a hue b* of the black toner in a powder state satisfying $13.59 \leq L^* \leq 11.35$, $-0.01 \leq a^* \leq 0.21$, and $-0.52 \leq b^* \leq -0.14$; and a black toner carrier that develops an electrostatic latent image for black with the black toner to form a toner image.

* * * * *